US011153943B2

(12) United States Patent
Sadahira et al.

(10) Patent No.: US 11,153,943 B2
(45) Date of Patent: Oct. 19, 2021

(54) MICROWAVE HEATING DEVICE

(71) Applicant: Panasonic Intellectual Property Management Co., Ltd., Osaka (JP)

(72) Inventors: Masafumi Sadahira, Shiga (JP); Koji Yoshino, Shiga (JP); Masayuki Kubo, Shiga (JP); Yoshiharu Omori, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 485 days.

(21) Appl. No.: 15/300,719

(22) PCT Filed: Jul. 9, 2015

(86) PCT No.: PCT/JP2015/003459
§ 371 (c)(1),
(2) Date: Sep. 29, 2016

(87) PCT Pub. No.: WO2016/006249
PCT Pub. Date: Jan. 14, 2016

(65) Prior Publication Data

US 2017/0171922 A1 Jun. 15, 2017

(30) Foreign Application Priority Data

Jul. 10, 2014 (JP) ..... JP2014-142315
May 19, 2015 (JP) ..... JP2015-101855

(51) Int. Cl.
*H05B 6/72* (2006.01)
*H05B 6/68* (2006.01)
(Continued)

(52) U.S. Cl.
CPC ..... *H05B 6/725* (2013.01); *H05B 6/687* (2013.01); *H05B 6/76* (2013.01)

(58) Field of Classification Search
CPC ..... H05B 6/76; H05B 6/687; H05B 6/725; H05B 6/70
(Continued)

(56) References Cited

U.S. PATENT DOCUMENTS 2,961,520 A * 11/1960 Long ..... H05B 6/725 219/763
3,467,803 A * 9/1969 Ojelid ..... H05B 6/725 219/748
(Continued)

FOREIGN PATENT DOCUMENTS

EP 148562 B1 1/1989
JP 60-130094 7/1985
(Continued)

OTHER PUBLICATIONS

International Search Report of PCT application No. PCT/JP2015/003459 dated Oct. 13, 2015.
(Continued)

*Primary Examiner* — Eric S Stapleton
(74) *Attorney, Agent, or Firm* — Crowell & Moring LLP

(57) ABSTRACT

A rotating antenna (105*a*) includes: a ceiling surface (109) and a side-wall surface (110) that constitute a waveguide structure (108); and a horn (113) that radiates a microwave into a heating chamber. The rotating antenna (105*a*) further includes a flange (112) that is formed on a periphery of the side-wall surface (110) so as to face a bottom surface (111), which is an inner wall surface of the heating chamber, and so as to surround the side-wall surface (110). The flange (112) has choke sections (117) that reduce a leakage of the microwave. This configuration can generate a relatively low impedance region so as to surround the side-wall surface (110), thereby enhancing a leakage reducing performance of the rotating antenna (105*a*) and increasing directivity of the microwave radiated from the rotating antenna (105*a*). Con-
(Continued)

sequently, if a part of substances to be heated arranged on a plate is a food that a user does not want to warm, the rotating antenna (105*a*) selectively heats an area in which a food that the user wants to warm is present but hardly heats the food that the user does not want to warm.

20 Claims, 18 Drawing Sheets

(51) Int. Cl.
*H05B 6/70* (2006.01)
*H05B 6/76* (2006.01)

(58) Field of Classification Search
USPC ..... 219/696, 660, 690, 680, 702, 706, 710, 219/745–750, 751, 705, 709, 720, 739, 219/741, 742, 753, 764, 778; 333/33, 333/204, 247, 219, 164
See application file for complete search history.

(56) References Cited

U.S. PATENT DOCUMENTS 3,798,404 A * 3/1974 Simon ..... H05B 6/72 219/751
3,823,295 A * 7/1974 Simon ..... H05B 6/6482 219/748
3,851,133 A * 11/1974 Dygve ..... H05B 6/6426 219/749
3,884,213 A * 5/1975 Smith ..... H05B 6/66 126/21 A
3,936,627 A * 2/1976 Fitzmayer ..... H05B 6/72 219/751
4,028,519 A * 6/1977 De Weese ..... H05B 6/6405 219/685
4,028,520 A * 6/1977 Torrey ..... H05B 6/6405 219/681
4,028,521 A * 6/1977 Uyeda ..... H05B 6/725 219/749
4,037,071 A * 7/1977 Kaufman, Jr. ..... H05B 6/705 219/749
4,088,862 A * 5/1978 Austin ..... H05B 6/6482 219/719
4,092,513 A * 5/1978 Rasmussen ..... H05B 6/74 219/751
4,105,886 A * 8/1978 Baron ..... F24C 7/02 219/685
4,121,078 A * 10/1978 Takano ..... H05B 6/72 219/754
4,133,997 A * 1/1979 Thuleen ..... H05B 6/6402 219/697
4,165,454 A * 8/1979 Carlsson ..... H05B 6/72 219/748
4,176,266 A * 11/1979 Kaneko ..... H05B 6/72 219/749
4,185,181 A * 1/1980 Kaneko ..... H05B 6/72 219/749
4,284,868 A * 8/1981 Simpson ..... H05B 6/725 219/749
4,314,127 A * 2/1982 Weiss ..... F24C 15/021 219/749
4,316,069 A * 2/1982 Fitzmayer ..... H05B 6/6482 219/746
4,324,967 A * 4/1982 Ikeda ..... H05B 6/72 219/749
4,327,266 A * 4/1982 Austin ..... H05B 6/74 219/749
4,332,992 A * 6/1982 Larsen ..... H05B 6/6435 126/21 A
4,335,289 A * 6/1982 Smith ..... H05B 6/642 219/749
4,335,290 A * 6/1982 Teich ..... H05B 6/6482 219/400
4,336,434 A * 6/1982 Miller ..... H05B 6/704 219/747
4,350,859 A * 9/1982 Dudley ..... H05B 6/72 219/749
4,358,653 A * 11/1982 Weiss ..... F24C 15/021 219/685
4,360,723 A * 11/1982 Fukuda ..... H05B 6/6411 219/711
4,363,957 A * 12/1982 Tachikawa ..... H05B 6/6482 219/497
4,390,768 A * 6/1983 Teich ..... G01G 19/414 219/708
4,410,779 A * 10/1983 Weiss ..... F24C 14/02 219/749
4,413,168 A * 11/1983 Teich ..... H05B 6/6435 219/708
4,414,453 A * 11/1983 Simpson ..... H05B 6/725 219/749
4,421,968 A * 12/1983 Osepchuk ..... H05B 6/6473 219/749
4,424,430 A * 1/1984 Almgren ..... H05B 6/74 219/749
4,430,538 A * 2/1984 Suzuki ..... H05B 6/74 219/749
4,430,539 A * 2/1984 Suzuki ..... H05B 6/74 219/749
4,431,888 A * 2/1984 Simpson ..... H05B 6/725 219/746
4,436,973 A * 3/1984 Ikeda ..... H05B 6/642 219/748
4,441,002 A * 4/1984 Teich ..... G01G 19/52 219/708
4,458,126 A * 7/1984 Dills ..... H05B 6/72 219/749
4,476,362 A * 10/1984 Kusunoki ..... H05B 6/72 219/748
4,477,706 A * 10/1984 Mittelsteadt ..... F24C 15/325 219/400
4,496,814 A * 1/1985 Fitzmayer ..... H05B 6/642 219/746
4,507,530 A * 3/1985 Smith ..... H05B 6/6447 219/703
4,507,531 A * 3/1985 Teich ..... G05F 1/66 219/718
4,508,948 A * 4/1985 Carlson ..... G01G 19/56 219/708
4,511,779 A * 4/1985 Bucksbaum ..... H05B 6/6402 219/732
4,521,658 A * 6/1985 Wyland ..... H05B 6/6435 177/144
4,525,615 A * 6/1985 Wyland ..... H05B 6/6435 219/703
4,546,225 A * 10/1985 McCammon ..... H05B 6/72 219/749
4,547,642 A * 10/1985 Smith ..... F24C 14/00 126/21 A
4,555,606 A * 11/1985 Thomas ..... F24C 14/02 126/21 A
4,556,771 A * 12/1985 Thomas ..... H05B 6/6405 219/685
4,556,772 A * 12/1985 McCammon ..... H05B 6/642 219/757
4,568,811 A * 2/1986 Yoshimura ..... H05B 6/6402 219/745
4,580,023 A * 4/1986 Simpson ..... H05B 6/72 219/749
4,580,025 A * 4/1986 Carlson ..... H05B 6/6435 219/702
4,596,915 A * 6/1986 Simpson ..... H05B 6/72 219/749
4,616,119 A * 10/1986 Shin ..... H05B 6/725 219/746
4,629,849 A * 12/1986 Mizutani ..... H05B 6/74 219/749

(56) References Cited

U.S. PATENT DOCUMENTS 4,641,006 A * 2/1987 Ross ..... H05B 6/725 219/749
4,642,435 A * 2/1987 Fitzmayer ..... H05B 6/72 219/749
4,673,783 A * 6/1987 Igarashi ..... H05B 6/72 219/746
4,695,693 A * 9/1987 Staats ..... H05B 6/72 219/748
4,714,811 A * 12/1987 Gerling ..... H05B 6/6411 219/751
4,765,066 A * 8/1988 Yoon ..... D06F 58/02 219/739
4,801,242 A * 1/1989 Eunbong ..... H05B 6/74 416/62
4,804,812 A * 2/1989 Tanaka ..... H05B 6/6482 219/685
4,833,285 A * 5/1989 Okamoto ..... H05B 6/72 219/746
4,833,286 A * 5/1989 Ohnishi ..... H05B 6/72 219/751
4,882,462 A * 11/1989 Husslein ..... H05B 6/688 219/709
4,954,680 A * 9/1990 Takenouchi ..... H05B 6/6408 219/763
4,967,050 A * 10/1990 Okamoto ..... H05B 6/72 219/746
5,155,318 A * 10/1992 Bowen ..... H05B 6/76 219/681
5,177,333 A * 1/1993 Ogasawara ..... H05B 6/129 219/601
5,204,503 A * 4/1993 Maiellano, Jr. ..... F24C 7/06 219/400
5,237,139 A * 8/1993 Berg ..... H05B 6/6411 219/697
5,347,108 A * 9/1994 Minakawa ..... H05B 6/6464 219/696
5,371,343 A * 12/1994 Yoshimura ..... A23L 3/365 219/746
5,442,160 A * 8/1995 Kimrey, Jr. ..... D06M 10/003 219/690
5,451,751 A * 9/1995 Takimoto ..... H05B 6/6411 219/687
5,491,323 A * 2/1996 Mori ..... H05B 6/645 219/494
5,781,087 A * 7/1998 Milroy ..... H01P 1/065 333/257
5,874,716 A * 2/1999 Park ..... H05B 6/70 219/746
5,986,249 A * 11/1999 Yoshino ..... H05B 6/688 219/746
5,990,466 A * 11/1999 McKee ..... H05B 6/70 219/697
5,990,467 A * 11/1999 Yang ..... H05B 6/642 126/21 A
6,008,483 A * 12/1999 McKee ..... H05B 6/76 219/746
6,172,348 B1 * 1/2001 Yoshino ..... H05B 6/66 219/704
6,222,170 B1 * 4/2001 Tucker ..... H05B 6/806 219/748
6,274,859 B1 * 8/2001 Yoshino ..... H05B 6/66 219/746
6,444,966 B2 * 9/2002 Mukumoto ..... H05B 6/72 219/748
6,614,011 B2 * 9/2003 Omori ..... H05B 6/72 219/748
6,812,443 B2 * 11/2004 Noda ..... H05B 6/74 219/695
6,861,632 B2 * 3/2005 Lee ..... H05B 6/6402 219/691
6,864,471 B2 * 3/2005 Mitsumoto ..... H05B 6/766 219/746
6,909,077 B2 * 6/2005 Eke ..... H05B 6/74 219/746
8,941,039 B2 * 1/2015 Galbreath ..... H05B 6/76 219/690
9,131,543 B2 * 9/2015 Ben-Shmuel ..... H05B 6/6402
9,215,756 B2 * 12/2015 Bilchinsky ..... H05B 6/687
9,538,585 B2 * 1/2017 Nordh ..... H05B 6/6494
9,907,123 B2 * 2/2018 Hofmann ..... H05B 6/76
2001/0002670 A1 * 6/2001 Omori ..... H05B 6/72 219/748
2001/0019054 A1 * 9/2001 Kawamura ..... H05B 6/725 219/711
2002/0158065 A1 * 10/2002 Taino ..... H05B 6/68 219/710
2002/0162836 A1 * 11/2002 Taino ..... H05B 6/725 219/710
2003/0098302 A1 * 5/2003 Hoh ..... H05B 6/6402 219/749
2004/0134905 A1 * 7/2004 Noda ..... H05B 6/725 219/749
2009/0090707 A1 * 4/2009 McNamee ..... H05B 6/647 219/725
2010/0276417 A1 * 11/2010 Uchiyama ..... H05B 6/6402 219/719
2010/0282742 A1 * 11/2010 Uchiyama ..... H05B 6/6402 219/702
2010/0288756 A1 * 11/2010 Uchiyama ..... H05B 6/6408 219/756
2010/0301039 A1 * 12/2010 Uchiyama ..... H05B 6/705 219/704
2011/0198344 A1 * 8/2011 Uchiyama ..... H05B 6/647 219/680
2011/0297671 A1 * 12/2011 Nordh ..... H05B 6/6494 219/690
2013/0087555 A1 * 4/2013 Hirano ..... H05B 6/687 219/720
2013/0249754 A1 * 9/2013 Rice, I ..... H01Q 19/19 343/756
2016/0088690 A1 * 3/2016 Kubo ..... H05B 6/70 219/749

FOREIGN PATENT DOCUMENTS

| | | |
|---|---|---|
| JP | 60-236491 | 11/1985 |
| JP | 4-064154 B | 10/1992 |
| JP | 2894250 B | 5/1999 |
| JP | 2005-235493 | 9/2005 |
| JP | 2007-141538 | 6/2007 |
| JP | 2007-294477 | 11/2007 |
| JP | 2014-120416 | 6/2014 |
| WO | 2013/001787 | 1/2013 |
| WO | 2014/171152 | 10/2014 |

OTHER PUBLICATIONS

English Translation of Chinese Search Report dated Feb. 3, 2019 for the related Chinese Patent Application No. 201580024430.X.

* cited by examiner

MICROWAVE HEATING DEVICE

CROSS-REFERENCE TO RELATED APPLICATIONS

This application is a U.S. national stage application of the PCT International Application No. PCT/JP2015/003459 filed on Jul. 9, 2015, which claims the benefit of foreign priority of Japanese patent applications 2014-142315 filed on Jul. 10, 2014 and 2015-101855 filed on May 19, 2015, the contents all of which are incorporated herein by reference.

TECHNICAL FIELD

The present disclosure relates to a microwave heating device, such as a microwave oven, that heats foods or other substances to be heated by means of a microwave.

BACKGROUND ART

Recently commercially practical microwave ovens are equipped with a simultaneously-cooking function. With this function, a microwave oven can simultaneously start heating a plurality of foods having different temperatures placed in the heating chamber and can simultaneously finish heating them.

If a microwave oven utilizes the simultaneously-cooking function to simultaneously start and finish heating a frozen food and a food maintained at ambient temperature, for example, the microwave oven needs to heat the cool food more strongly than the warm food. This is because if both foods are heated in the same manner, there are cases where the frozen food is not yet heated enough although the food that has been maintained at ambient temperature is completely heated.

To achieve the above simultaneously-cooking function, microwave oven needs to be equipped with a function of selectively heating a part of heating substances to be heated in the heating chamber (referred to below as "local heating"), instead of a function of uniformly heating all the substances to be heated in the heating chamber (referred to below as "uniform heating").

Means for performing the local heating has been proposed (e.g., refer to PTL 1 and PTL 2). More specifically, an infrared sensor detects an inner temperature of a heating chamber. Then, based on the distribution of the detected temperature, a controller controls the start and end of the rotation of a rotating antenna installed under the bottom surface of the heating chamber (abbreviated below as the "bottom surface") at substantially the center.

In the above patent literature, the directivity of each rotating antenna is set such that an intensity of microwave radiation increases outwardly. When a plurality of foods are cocked, the rotating antenna stops moving and oriented toward a cool food over a preset time period. The local heating of the cool food is thereby controlled.

Next, configurations of a rotating antenna having a superior local heating performance, called a rotating waveguide system, will be described using the rotating antennas disclosed in the above patent literature.

FIG. 18A is a front cross-sectional view of a conventional microwave heating device described in Patent Literature 1. FIG. 18B is a plan view of the conventional rotating antenna described in Patent Literature 1. FIG. 19A is a plan view of a conventional rotating antenna described in Patent Literature 2. FIG. 19B is a plan view of another conventional rotating antenna described in Patent Literature 2.

As illustrated in FIG. 18A to FIG. 19B, rotating antenna 1*a* has waveguide structure 3*a* formed into a boxlike shape; rotating antenna 1*b* has waveguide structure 3*b* formed into a boxlike shape; and rotating antenna 1*c* has waveguide structure 3*c* formed into a boxlike shape. Waveguide structure 3*a* surrounds coupling shaft 2*a* via which a microwave is to be supplied to the interior of the heating chamber; waveguide structure 3*b* surrounds coupling shaft 2*b* via which a microwave is to be supplied to the interior of the heating chamber; and waveguide structure 3*c* surrounds coupling shaft 2*c* via which a microwave is to be supplied to the interior of the heating chamber.

Waveguide structure 3*a* includes: ceiling surface 4*a* to which coupling shaft 2*a* is coupled; and side-wall surface 5*aa*, side-wall surface 5*ab*, side-wall surface 5*ac* that cover three outer sides of ceiling surface 4*a*. Flanges 7*a* formed in parallel to bottom surface 6 with a small gap therebetween are provided outside side-wall surfaces 5*aa*, 5*ab*, 5*ac*. Rotating antenna 1*a* is provided with horn 8*a*, which is wide opened only in one direction.

Likewise, waveguide structure 3*b* includes: ceiling surface 4*b* to which coupling shaft 2*b* is coupled; and side-wall surface 5*ba*, side-wall surface 5*bb*, side-wall surface 5*bc* that cover three outer sides of ceiling surface 4*b*. Flanges 7*b* formed in parallel to bottom surface 6 with a small gap therebetween are provided outside side-wall surfaces 5*ba*, 5*bb*, 5*bc*. Rotating antenna 1*b* is provided with horn 8*b*, which is wide opened only in one direction.

Waveguide structure 3*c* includes: ceiling surface 4*c* to which coupling shaft 2*c* is coupled; and side-wall surface 5*ca*, side-wall surface 5*cb*, side-wall surface 5*cc* that cover three outer sides of ceiling surface 4*c*. Flanges 7*c* formed in parallel to bottom surface 6 with a small gap therebetween are provided outside side-wall surfaces 5*ca*, 5*cb*, 5*cc*. Rotating antenna 1*c* is provided with horn 8*c*, which is wide opened only in one direction.

Rotating antenna 1*a* radiates a major part of a microwave from horn 8*a*, increasing directivity of the microwave radiated from horn 8*a*. Rotating antenna 1*b* radiates a major part of a microwave from horn 8*b*, increasing directivity of microwave radiated from horn 8*b*. Rotating antenna 1*c* radiates a major part of a microwave from horn 8*c*, increasing directivity of microwave radiated from horn 8*c*.

CITATION LIST

Patent Literature

PTL 1: Unexamined Japanese Patent Publication No. 60-130094

PTL 2: Japanese Patent No. 2,894,250

SUMMARY OF THE INVENTION

All of the conventional microwave heating devices described above aim to heat a plurality of foods to a desired temperature. This aim can be accomplished even when a rotating antenna leaks a certain amount of electric field in directions other than a heating direction.

Unfortunately, the conventional rotating antennas may be unable to provide a performance of sufficiently reducing a leakage of a microwave (referred to below as a "leakage reducing performance"). Therefore, even if a part of a plurality of foods is a food that a user does not want to warm, such as a salad, these conventional microwave heating devices might heat this food.

To avoid the above disadvantage, if a cooked food and a salad are arranged on a single plate, a user needs to temporarily transfer the food that he/she does not warm to another plate and warm only the cooked food. Thus, due to their insufficient leakage reducing performance, the conventional microwave heating devices may impose a considerable time and laborious work upon a user.

The present disclosure addresses the above conventional problem with an object of providing a microwave heating device that provides a better leakage reducing performance and that, when a part of substances to be heated placed on a plate is a food that a user does not want to warm, selectively heats an area in which a food that the user wants to warm is present but hardly heats the food that the user does not want to warm.

A microwave heating device according to an aspect of the present disclosure, which addresses the foregoing conventional problem, includes: a heating chamber that accommodates a substance to be heated; a microwave generator that generates a microwave; a rotating antenna having a waveguide structure; a driver that rotates the rotating antenna; and a controller that controls the microwave generator and the driver.

The above rotating antenna includes: a ceiling surface and a side-wall surface that constitute a waveguide structure; and a microwave radiator that radiates a microwave into the heating chamber. The rotating antenna further includes a flange that is formed on a periphery of the side-wall surface so as to face an inner wall surface of the heating chamber and so as to surround the side-wall surface. The flange has choke sections that reduce a leakage of the microwave.

According to this aspect, a rotating antenna generates a relatively low impedance region so as to surround the periphery of a side-wall surface. This can enhance a leakage reducing performance of choke sections and can increase directivity of microwave radiation. Consequently, if a part of substances to be heated arranged on a plate is a food that a user does not want to warm, a microwave heating device can selectively heat an area in which a food that the user wants to warm is present, with a minimal risk of heating a food that the user does not want to warm.

DESCRIPTION OF EMBODIMENTS

Figure 1:
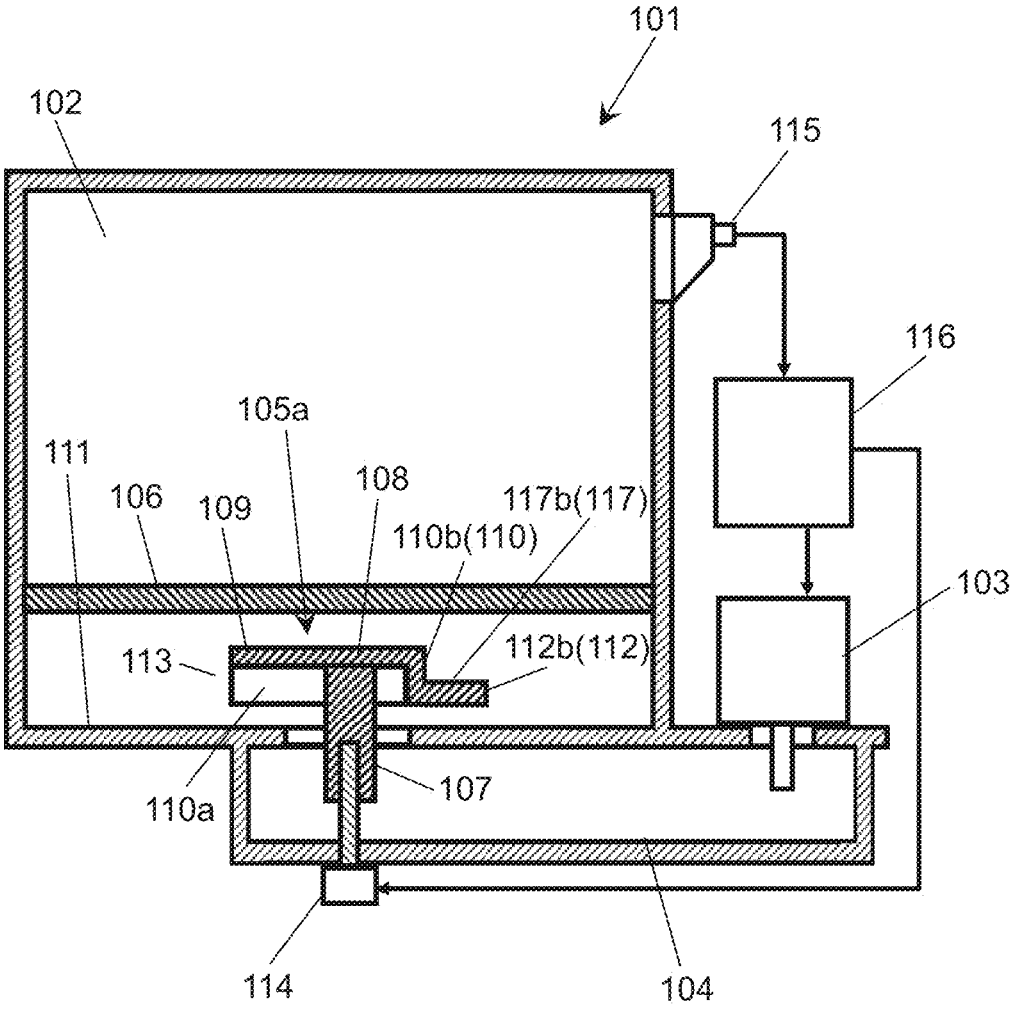
FIG. 1 is a block diagram of a microwave heating device according to a first exemplary embodiment, including its front cross-sectional view.

A microwave heating device according to a first aspect of the present disclosure includes: a heating chamber that accommodates a substance to be heated; a microwave generator that generates a microwave; a rotating antenna having a waveguide structure; a driver that rotates the rotating antenna; and a controller that controls the microwave generator and the driver.

The above rotating antenna includes: a ceiling surface and a side-wall surface that constitute a waveguide structure; and a microwave radiator that radiates a microwave into the heating chamber. The rotating antenna further includes a flange that is formed on a periphery of the side-wall surface so as to face an inner wall surface of the heating chamber and so as to surround the side-wall surface. The flange has choke sections that reduce a leakage of the microwave.

According to this aspect, a rotating antenna generates a relatively low impedance region so as to surround the periphery of a side-wall surface. This can enhance a leakage reducing performance of choke sections and can increase directivity of microwave radiation. Consequently, a microwave heating device provides a better leakage reducing performance, and if a part of substances to be heated arranged on a plate is a food that a user does not want to warm, the microwave heating device selectively heats an area in which a food that the user wants to warm is present but hardly heats a food that the user does not want to warm.

As a second aspect of the present disclosure, the microwave heating device in the first aspect may be configured such that each of the choke sections is formed in the flange so that a gap between the flange and the inner wall surface of the heating chamber changes with location.

According to this aspect, it is possible to form choke sections that have a good leakage reducing performance in a flange.

As a third aspect of the present disclosure, the microwave heating device in the first aspect may be configured such that each of the choke sections in the flange includes slits formed in the flange.

According to this aspect, it is possible to form choke sections that have a good leakage reducing performance in a flange.

As a fourth aspect of the present disclosure, the microwave heating device in one of the first to third aspects may be configured such that the choke sections are disposed periodically in the flange.

According to this aspect, it is possible to form choke sections that have a good leakage reducing performance in a flange.

As a fifth aspect of the present disclosure, the microwave heating device in one of the first to fourth aspects may be configured such that a length between the periphery of the side-wall surface and an edge of the flange is equal to substantially one quarter of a wavelength of the microwave.

According to this aspect, it is possible to provide a microwave heating device that can ensure a fundamental leakage reducing performance of choke sections formed in a flange and can reduce diffraction of an electric field that has leaked from each side-wall surface.

As a sixth aspect of the present disclosure, the microwave heating device in one of the first to fourth aspects may be configured such that the rotating antenna further includes a coupling shaft that has a first end coupled to the ceiling surface and a second end coupled to the driver. A length of the ceiling surface in a direction parallel to a center line of the waveguide structure which passes through a center of the coupling shaft and a middle of the microwave radiator may be greater than a length of the ceiling surface in a direction perpendicular to the center line.

According to this aspect, it is possible to enhance a leakage reducing performance and to increase directivity of a microwave by directing a microwave that has not leaked to a target area.

As a seventh aspect of the present disclosure, the microwave heating device in one of the first to sixth aspects may be configured such that the ceiling surface has at least one opening.

According to this aspect, it is possible to enhance a leakage reducing performance and to increase directivity of a microwave by directing a microwave that has not leaked to a target area.

As an eighth aspect of the present disclosure, the microwave heating device in the seventh aspect may be configured such that the rotating antenna further includes a coupling shaft that has a first end coupled to the ceiling surface and a second end coupled to the driver. In addition, the opening is positioned shifted from a center line of the waveguide structure which passes through a center of the coupling shaft and a middle of the microwave radiator, and rotation round polarization is radiated from the opening.

According to this aspect, it is possible to improve uniformity of heating distribution around an opening.

As a ninth aspect of the present disclosure, the microwave heating device in one of the first to eighth aspects may be configured such that a resonator is formed so as to cover the flange and the side-wall surface, and a resonant space surrounded by the side-wall surface, the flange, and the resonator is created. According to this aspect, it is possible to enhance a leakage reducing performance of choke sections.

As a tenth aspect of the present disclosure, the microwave heating device in the ninth aspect may be configured such that the flange constitutes a part of the resonator.

According to this aspect, it is possible to form more compact choke sections, thereby controlling enlargement of a rotating antenna.

As an eleventh aspect of the present disclosure, the microwave heating device in the tenth aspect may be configured such that slits are formed in both the flange and the resonator, and the slits formed in the resonator and the slits formed in the flange are positioned alternately so as not to be aligned with each other.

According to this aspect, it is possible to enhance a leakage reducing performance of choke sections.

Some preferred exemplary embodiments of a microwave heating device according to the present disclosure will be described below with reference to the accompanying drawings. A microwave oven is described as an example in the exemplary embodiments that will be described below; however, a microwave heating device according to the present disclosure is not limited to a microwave oven. Other examples include a garbage disposal machine using microwave heating and a semiconductor manufacturing apparatus.

The present disclosure is not limited to specific configurations in the exemplary embodiments that will be described below, and configurations based on similar technical ideas should also be incorporated in the present disclosure.

First Exemplary Embodiment

Figure 2:
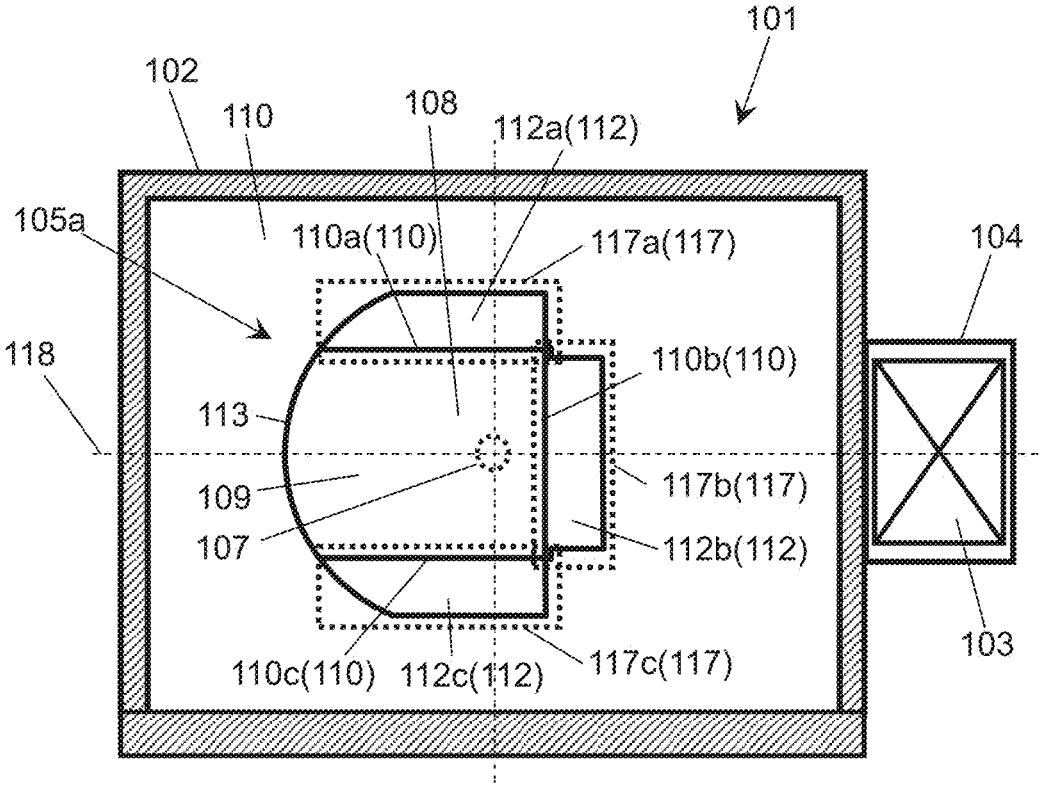
FIG. 2 is a cross-sectional, plan view of the microwave heating device according to the first exemplary embodiment as seen from the above.

FIG. 1 to FIG. 7C are views used to explain a configuration of a microwave heating device according to a first exemplary embodiment of the present disclosure. FIG. 1 is a block diagram of a microwave heating device according to this exemplary embodiment, including its front cross-sectional view. FIG. 2 is a cross-sectional, plan view of the microwave heating device according to this exemplary embodiment as seen from the above.

As illustrated in FIG. 1 and FIG. 2, microwave oven 101, which is a microwave heating device, includes heating chamber 102, magnetron 103, waveguide 104, rotating antenna 105*a*, and mounting table 106.

Heating chamber 102 accommodates a food (not illustrated), or a substance to be heated. Magnetron 103 typifies a microwave generator that generates a microwave. Waveguide 104 allows a microwave emitted from magnetron 103 to travel to rotating antenna 105*a*. Rotating antenna 105*a* radiates the microwave that has propagated in waveguide 104 into heating chamber 102. Mounting table 106 is used to place a food thereon.

The front surface of heating chamber 102 having an opening is provided with a door (not illustrated) that can be opened or closed.

In this exemplary embodiment, the first side of heating chamber 102 on which the opening is formed is defined as the front side, whereas the second side of heating chamber 102 opposite the first side is defined as the rear side. Furthermore, the right side of heating chamber 102 as seen from the direction from the front side to the rear side is defined as the right side, whereas the left side of heating chamber 102 as seen from the direction from the front side to the rear side is defined as the left side.

Mounting table 106 covers entire bottom surface 111, which is one inner wall surface of heating chamber 102. Mounting table 106 separates the inner space of heating chamber 102 into a food storage space positioned on the upper side and an antenna storage space positioned on the lower side. Mounting table 106 is preferably made of a glass or ceramic material that allows a microwave to pass through mounting table 106 easily, for the purpose of helping radiate a microwave from rotating antenna 105*a* into heating chamber 102.

Rotating antenna 105*a* has waveguide structure 108 formed into a substantially boxlike shape, waveguide structure 108 having an opening on its lower side and surrounding coupling shaft 107. Coupling shaft 107 has an upper end coupled to rotating antenna 105*a* and a lower end coupled to the drive shaft of driver 114.

Rotating antenna 105*a* is rotatably installed under bottom surface 111 so as to radiate the microwave that has propagated in waveguide 104 and coupling shaft 107 toward a target area.

The wall surfaces constituting waveguide structure 108 include: ceiling surface 109 to which coupling shaft 107 is coupled; and side-wall surface 110*a*, side-wall surface 110*b*, and side-wall surface 110*c*, which are formed by bending downward the peripheries of ceiling surface 109. Hereinafter, each of side-wall surfaces 110*a*, 110*b*, and 110*c* is collectively referred to as side-wall surface 110. Side-wall surfaces 110 surround three outer sides of ceiling surface 109.

Ceiling surface 109 is disposed in substantially parallel to bottom surface 111. Flange 112*a* is formed outside side-wall surface 110*a*; flange 112*b* is formed outside side-wall surface 110*b*; and flange 112*c* is formed outside side-wall surface 110*c*. Hereinafter, each of flanges 112*a*, 112*b*, and 112*c* is collectively referred to as flange 112.

Each flange 112 is formed in parallel to bottom surface 111 with a small gap therebetween. Flange 112*a* is provided with choke section 117*a*; flange 112*b* is provided with choke section 117*b*; and flange 112*c* is provided with choke section 117*c*. Each of choke sections 117*a*, 117*b*, and 117*c* reduces a leakage of a microwave from waveguide structure 108. Hereinafter, each of choke sections 117*a*, 117*b*, and 117*c* is collectively referred to as choke section 117.

Flange 112*a* extends from the lower edge of side-wall surface 110*a* to the outside of waveguide structure 108 while being perpendicular to side-wall surface 110*a*. Likewise, flange 112*b* extends from the lower edge of side-wall surface 110*b*, and flange 112*c* extends from the lower edge of side-wall surface 110*c*.

Notches are formed between flanges 112*a* and 112*b* and between flanges 112*b* and 112*c*. In other words, rotating antenna 105*a* does not have a flange between flanges 112*a* and 112*b* which connects flanges 112*a* and 112*b* and a flange between flanges 112*b* and 112*c* which connects flanges 112*b* and 112*c*.

The side of waveguide structure 108 other than the three sides covered with the side-wall surfaces is wide opened, and horn 113 that functions as a microwave radiator is formed in this opening. Rotating antenna 105*a* radiates a microwave in the direction from coupling shaft 107 to horn 113.

Microwave oven 101 according to this exemplary embodiment further includes driver 114, infrared sensor 115, and controller 116. Driver 114 drives a motor (not illustrated) that rotates rotating antenna 105*a*. Infrared sensor 115 detects a temperature of a food. Controller 116 controls an oscillation of magnetron 103 and a rotation of rotating antenna 105*a* caused by driver 114, based on an output signal from infrared sensor 115.

Waveguide structure 108, ceiling surface 109, and side-wall surfaces 110 create a substantially cubic body, and waveguide structure 108 allows a microwave to be radiated in the direction from coupling shaft 107 to horn 113. As illustrated in FIG. 2, coupling shaft 107 is disposed at substantially the center of bottom surface 111.

To help an understanding of waveguide structure 108, a typical waveguide will be described with reference to FIG. 3.

Figure 3:
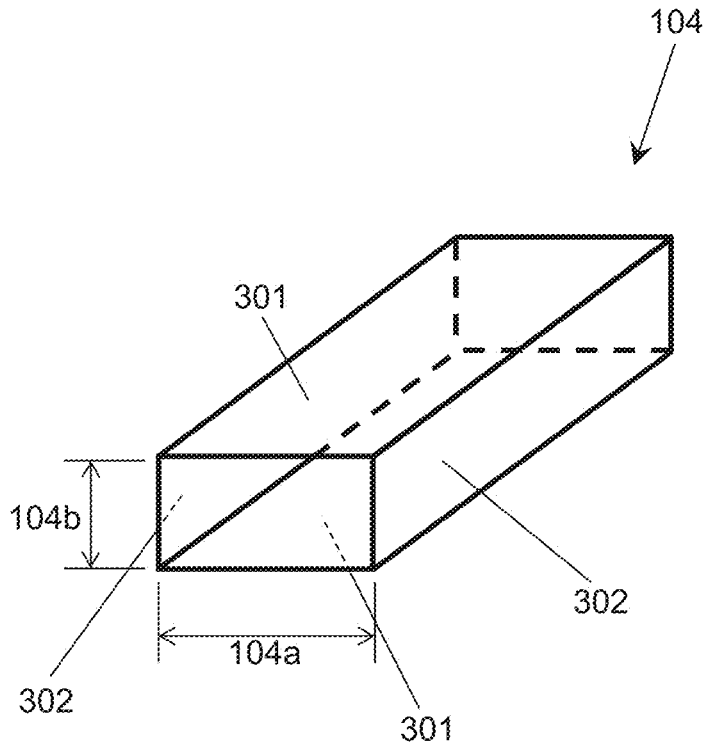
FIG. 3 is a perspective view of a typical waveguide structure.

FIG. 3 is a perspective view of the simplest one of typical waveguides. As illustrated in FIG. 3, normally, waveguide

104 is a cubic waveguide and has a rectangular cross section with uniform width 104*a* and height 104*b*. A microwave is transmitted in waveguide 104 in a longitudinal direction.

As known in the art, if waveguide 104 is designed such that width 104*a* and height 104*b* fall within predetermined ranges, more specifically such that λ0>width 104*a*>λ0/2 (λ0 denotes a wavelength of a microwave within a free space) and height 104*b*<λ0/2, a microwave in a TE10 mode propagates inside the waveguide.

The term "TE10 mode" refers to a mode in which a microwave is transmitted as an H wave or a TE (transverseelectric) wave and only a magnetic field component is present and thus an electric field component is absent in waveguide 104 in a propagation direction of the microwave.

Prior to an explanation about a guide wavelength λg in waveguide 104, wavelength λ0 of a microwave in a free space will be described.

As known in the art, a microwave emitted from a typical microwave oven has wavelength λ0 of approximately 120 mm in a free space.

More specifically, wavelength λ0 is calculated from speed c of light and frequency f of a microwave through equation (1).

$$\lambda 0 = c/f \tag{1}$$

Speed c of light is $3.0\times10^8$ [m/s], and frequency f of a microwave varies in the range from 2.4 [GHz] to 2.5 [GHz] (ISM band).

Oscillating frequency f of a microwave from magnetron 103 depends on a load condition, for example. Wavelength λ0 in a free space has a minimum value of 120 [mm] (in the case where the oscillating frequency is 2.5 GHz) and a maximum value of 125 [mm] (in the case where the oscillating frequency is 2.4 GHz). Thus, wavelength λ0 varies in this range.

In many cases, typical waveguide 104 is designed such that width 104*a* is set in the range from approximately 80 mm to 100 mm and height 104*b* is set in the range from approximately 15 mm to 40 mm, in consideration of a variation range of wavelength λ0 in a free space. In FIG. 3, the vertical narrow plain is referred to as E plain 302, because this narrow plain is parallel to an electric field. The horizontal wide plain that is wider than the above narrow plain is referred to as H plain 301, because a magnetic field swirls in the horizontal wide plain.

Guide wavelength λg of a microwave, which is a wavelength of the microwave propagating in waveguide 104, is expressed by equation (2).

$$\lambda g = \frac{\lambda 0}{\sqrt{1-(\lambda 0/(2\cdot a))\cdot 2}} \tag{2}$$

Guide wavelength λg is dependent on width 104*a* of waveguide 104 but independent of height 104*b* of waveguide 104. In the TE10 mode, an electric field becomes zero on both sides of waveguide 104 in a width direction, namely, on E plains 302 and becomes the maximum in the middle of waveguide 104 in a width direction.

As illustrated in FIG. 1 and FIG. 2, the above principle is also applicable to rotating antenna 105*a* according to this exemplary embodiment. More specifically, in this exemplary embodiment, each of ceiling surface 109 and bottom surface 111 constitutes H plain 301, and each of side-wall surfaces 110*a* and 110*c* constitutes E plain 302. Side-wall surface 110*b* serves as a reflective end at which all the microwave is reflected toward horn 113.

In this exemplary embodiment, width 104*a* of waveguide structure 108 may be set in the range from 80 [mm] to 100 [mm] as a typical value and set to 120 [mm] as a maximum value.

A description will be given below of an operation of microwave oven 101 according to this exemplary embodiment. A user operates an operating section (not illustrated) of microwave oven 101 to give an instruction of starting a heating operation. In response to this instruction, magnetron 103 starts outputting a microwave. The microwave output from magnetron 103 is radiated from horn 113 into heating chamber 102 via waveguide 104, coupling shaft 107, and rotating antenna 105*a*.

Controller 116 detects a temperature of a substance to be heated (not illustrated) placed on mounting table 106 in heating chamber 102, in accordance with an output signal from infrared sensor 115. Controller 116 controls an orientation and a rotational speed of rotating antenna 105*a* by driving driver 114. If microwave oven 101 aimed only to heat a substance to be heated to a desired temperature, the above basic configuration and operation could accomplish this aim.

However, if a food that the user wants to heat and a food that the user does not want to heat are arranged on a single plate, it is important to enhance a leakage reducing performance by using a configuration of flanges 112 and choke section 117 provided in each flange 112.

A description will be given below of how to enhance a leakage reducing performance of choke sections 117 in this exemplary embodiment.

(1) Method Using Choke Section

First, a description will be given of a method using a gap between flange 112 and bottom surface 111 and a method using a configuration of slits, as methods of enhancing a leakage reducing performance of choke sections 117.

(1-a) Method of Adjusting Gap Between Flange and Bottom Surface

A description will be given below of a method of enhancing a leakage reducing performance by adjusting a gap between flange 112*b* and bottom surface 111, with reference to FIG. 4A to FIG. 4D.

The easiest way of enhancing a leakage reducing performance is to bring flange 112*b* into contact with bottom surface 111, thereby eliminating a gap between flange 112*b* and bottom surface 111.

Employing the above way, however, may degrade a function that rotating antenna 105*a* fulfills as a rotating waveguide. Therefore, a gap is adjusted between flange 112*b* and bottom surface 111 so that the gap changes with location, namely, so that impedance changes with location. Adjusting the gap in this manner can enhance the leakage reducing performance while maintaining the rotational function.

Figure 4A:
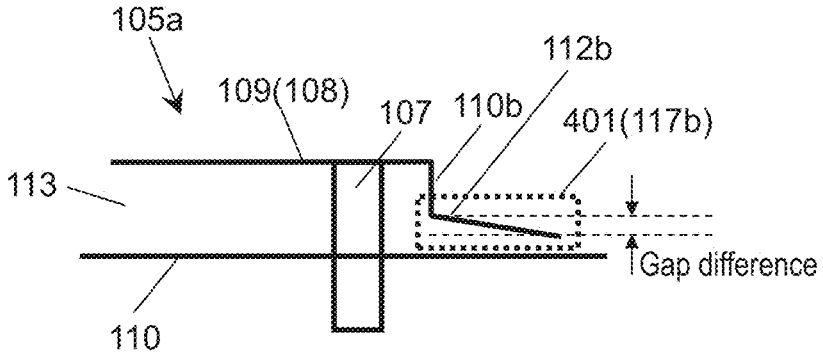
FIG. 4A is a schematic view of a rotating antenna as seen from a lateral side, which is used to explain an exemplary choke section in this exemplary embodiment.

FIG. 4A is a schematic view of rotating antenna 105*a* as seen from a lateral side, which is used to explain an exemplary choke section in this exemplary embodiment.

As illustrated in FIG. 4A, flange 112*b* is provided with gap adjuster 401. Gap adjuster 401 slopes down toward bottom surface 111 so that the gap between flange 112*b* and bottom surface 111 decreases with distance from side-wall surface 110*b*. This shape causes impedance to decrease from side-wall surface 110*b* toward the open end of flange 112*b*. As a result, flange 112*b* can form choke section 117*b* that reduces a leakage of a microwave.

Likewise, flange 112*a* is provided with choke section 117*a*, and flange 112*c* is provided with choke section 117*c*.

Figure 4B:
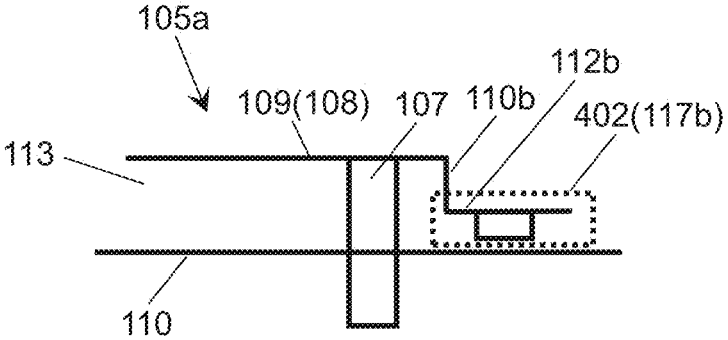
FIG. 4B is a schematic view of a rotating antenna as seen from a lateral side, which is used to explain another exemplary choke section in this exemplary embodiment.

FIG. 4B is a schematic view of rotating antenna 105*a* as seen from a lateral side, which is used to explain another exemplary choke section in this exemplary embodiment.

As illustrated in FIG. 4B, flange 112*b* is provided with gap adjuster 402. Gap adjuster 402 has a projection that protrudes downward from flange 112*b*. This shape enables the impedance of the projection to be higher than the impedance of side-wall surface 110*b* and the impedance at the open end of flange 112*b*.

As a result, flange 112*b* can form choke section 117 that reduces a leakage of a microwave. In this case, the impedance at the open end of flange 112*b* is set to be lower than the impedance of side-wall surface 110*b*.

Providing side-wall surfaces 110 with choke sections 117 successfully ensures a fundamental leakage reducing performance of choke sections 117 and can suppress an electric field from leaking from a side-wall surface and diffracting toward another side-wall surface. Moreover, the microwave that has not leaked is directed to a target area, increasing directivity of the microwave radiated from rotating antenna 105*a*.

Likewise, flange 112*a* is provided with choke section 117*a*, and flange 112*c* is provided with choke section 117*c*.

Figure 4C:
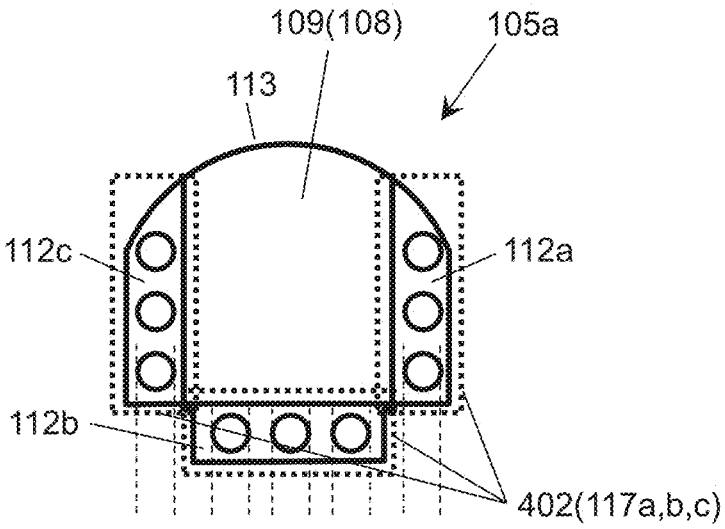
FIG. 4C is a schematic view of a rotating antenna as seen from a rear side, which is used to explain the other exemplary choke section in this exemplary embodiment.
Figure 4D:
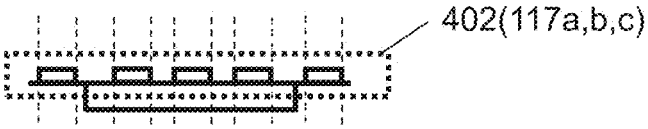
FIG. 4D is a schematic view of the rotating antenna illustrated in FIG. 4C as seen from a lateral side.

If the above projection is provided in flange 112*b*, the projection does not necessarily have to be provided in the whole of the flange. FIG. 4C is a schematic view of rotating antenna 105*a* as seen from a rear side, which is used to explain the other exemplary choke section in this exemplary embodiment. FIG. 4D is a schematic view of rotating antenna 105*a* illustrated in FIG. 4C as seen from the front.

As illustrated in FIG. 4C and FIG. 4D, cylindrical projections may be formed periodically in each of flanges 112*a*, 112*b*, 112*c* at regular intervals that are shorter than one quarter of an oscillation wavelength.

The above configuration successfully enhances a leakage reducing performance of choke sections 117 and causes a microwave that has not leaked from choke sections 117 to be radiated from horn 113. Consequently, it is possible to enhance directivity of a microwave radiated from rotating antenna 105*a* to a target area.

According to the above configuration, providing gap adjusters 401, 402 can change a gap between flange 112 and bottom surface 111 with location. As a result, even if a part of substances to be heated arranged on a plate is a food that a user does not want to warm, microwave oven 101 can selectively heat an area in which a food that the user wants to warm is present, with a minimal risk of heating a food that the user does not want to warm.

(1-b) Method Using Slit Configuration

A description will be given of a method of enhancing a leakage reducing performance by forming slits in each flange 112, with reference to FIG. 5A to FIG. 5C.

Figure 5A:
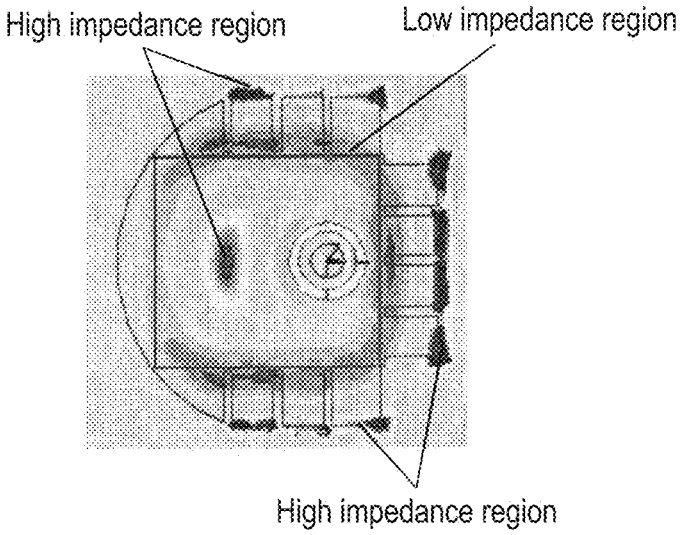
FIG. 5A is an analysis diagram showing a distribution of impedance in the vicinity of the flanges when slits are periodically formed in the whole of each flange at regular intervals, in the first exemplary embodiment.

FIG. 5A is a CAE analysis result showing a distribution of impedance in the vicinity of flanges 112 when slits are periodically formed in the whole of each flange 112 at regular intervals. In the example illustrated in FIG. 5A, slits having a width of 5 mm are periodically formed at intervals of 26 mm.

Figure 5B:
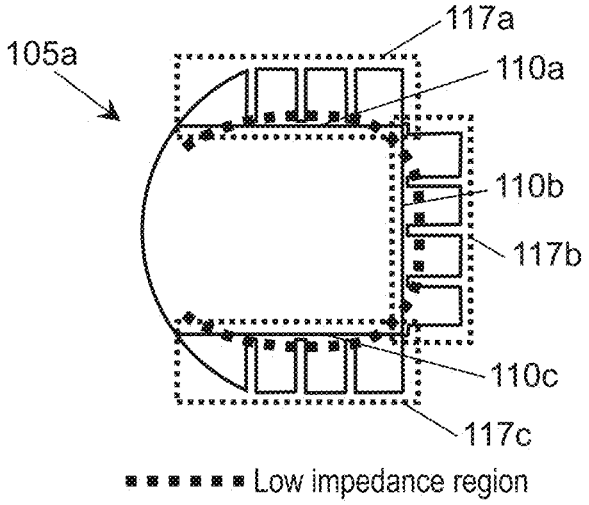
FIG. 5B is a view of a low impedance region in the vicinity of the flanges when the slits are periodically formed in the whole of each flange at regular intervals.

FIG. 5B is a view of a low impedance region in the vicinity of the flanges when the slits are periodically formed in the whole of each flange at regular intervals. FIG. 5C is a view of a low impedance region in the vicinity of the flanges when the slits are periodically formed only in side-wall surface 110*b* at regular intervals.

Figure 5C:
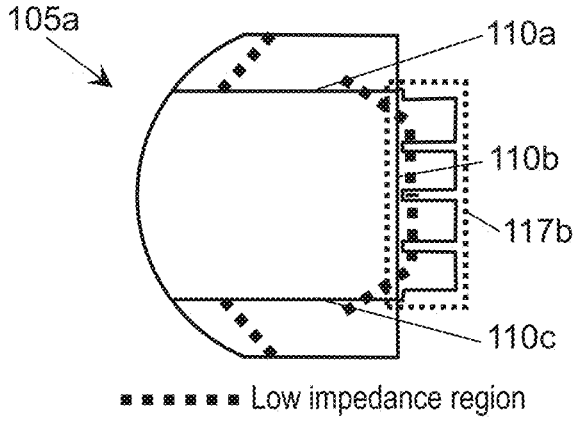
FIG. 5C is a view of a low impedance region in the vicinity of the flanges when the slits are periodically formed only in side-wall surface 110*b* at regular intervals.

It can be found from the comparison between FIG. 5B and FIG. 5C that a low impedance region is generated in the vicinity of each side-wall surface 110. Thus, choke sections 117 in each of which the slits are periodically formed at regular intervals generate a low impedance region so as to surround side-wall surfaces 110.

The above configuration successfully enhances a leakage reducing performance of choke sections 117 and causes a microwave that has not leaked from choke section 117 to be radiated from horn 113. It is thus possible to increase directivity of the microwave radiated from rotating antenna 105*a* to a target area.

Providing side-wall surfaces 110 with choke sections 117 successfully ensures a fundamental leakage reducing performance of choke sections 117 and can suppress an electric field from leaking from a side-wall surface and diffracting toward another side-wall surface. Moreover, the microwave that has not leaked is directed to a target area, increasing directivity of a microwave radiated from rotating antenna 105*a*.

In the above configuration, the slits are preferably formed at intervals shorter than one quarter of a wavelength of a microwave, thereby suppressing a flow of the microwave from being generated between the slits.

According to the above configuration, choke sections 117 successfully generate a relatively low impedance region in flanges 112 so as to surround side-wall surfaces 110. Consequently, it is possible to enhance the leakage reducing performance, thereby causing a microwave that has not leaked to be radiated from horn 113.

(2) Method of Enhancing Leakage Reducing Performance with Flange Configuration

Next, a description will be given of a method of enhancing a leakage reducing performance with a configuration of flanges 112, with reference to FIG. 6.

Figure 6:
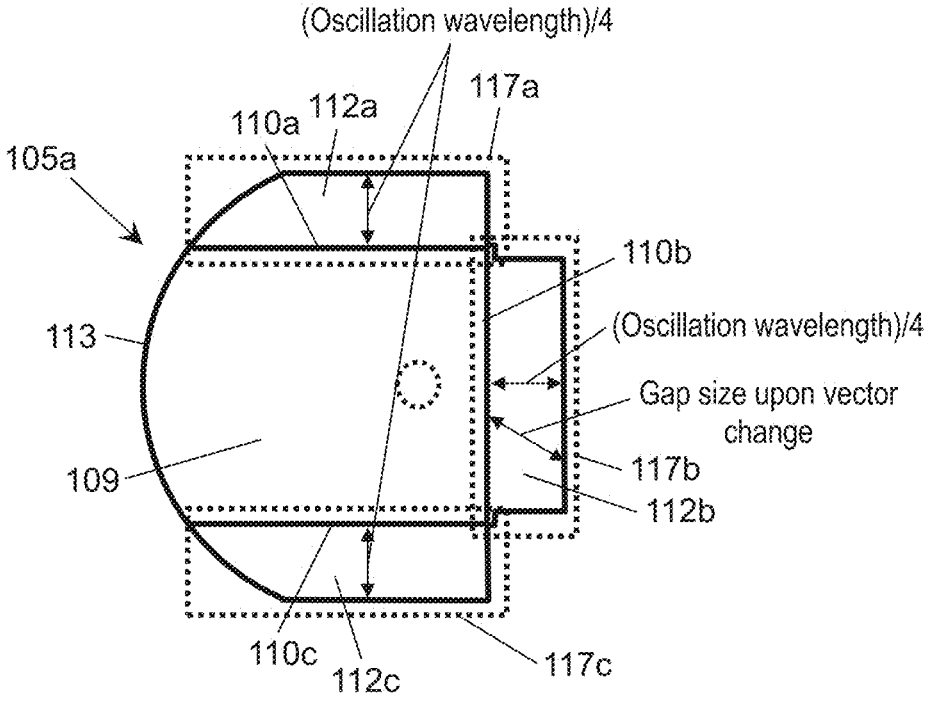
FIG. 6 is a plan view of a rotating antenna, which is used to explain a function of the flanges according to the first exemplary embodiment.

FIG. 6 is a plan view of rotating antenna 105*a*, which is used to explain a function of flange 112 according to this exemplary embodiment.

To enhance a leakage reducing performance, as illustrated in FIG. 6, it is necessary to appropriately set lengths between side-wall surfaces 110 and the outer edges of corresponding flanges 112. In this exemplary embodiment, each length is set to one quarter of a wavelength of a microwave generated by magnetron 103.

According to this configuration, choke sections 117 successfully generate a relatively low impedance region in flanges 112 so as to surround side-wall surfaces 110. Consequently, it is possible to enhance the leakage reducing performance and to cause a microwave that has not leaked to be radiated from horn 113.

(3) Method of Enhancing Leakage Reduction with Dimension of Waveguide Structure

Finally a description will be given of a method of enhancing a leakage reducing performance with a dimension of waveguide structure 108, with reference to FIG. 7A to FIG. 7C.

Figure 7A:
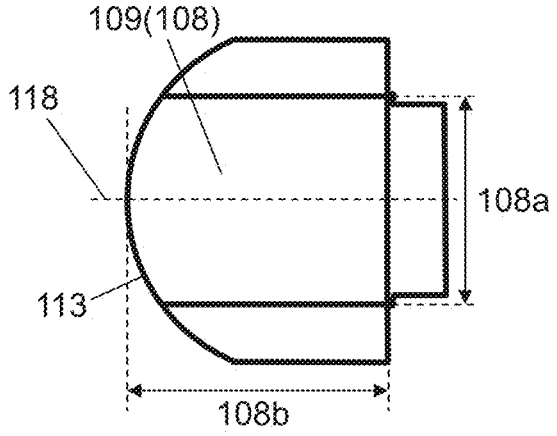
FIG. 7A is a view used to show a definition of a width and a length of the waveguide structure.

FIG. 7A is a view used to show a definition of a width and a length of the waveguide structure. As illustrated in FIG. 7A, waveguide structure 108 has a shape in which length 108*b* is considerably longer than width 108*a*. Herein, length 108*b* is defined as the maximum length of ceiling surface 109 in a direction parallel to the center line of waveguide structure 108 (referred to below as "center line 118") which passes through the center of coupling shaft 107 and the middle of horn 113. Width 108*a* is defined as the maximum length of ceiling surface 109 in a direction perpendicular to center line 118.

When transferred to waveguide structure 108 via coupling shaft 107, a microwave travels inside waveguide structure 108 while being reflected on side-wall surfaces 110*a*, 110*c*.

Figure 7B:
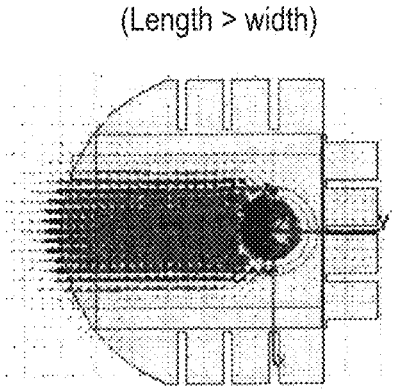
FIG. 7B is a flow of microwave energy when a length of the waveguide structure is set to be larger than a width thereof.
Figure 7C:
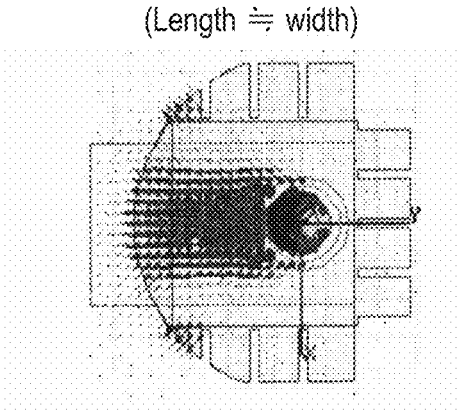
FIG. 7C is a flow of microwave energy when a length of the waveguide structure is set to be substantially the same as a width thereof.

FIG. 7B and FIG. 7C are CAE analysis results showing flows of microwave energy in two waveguide structures having different ratios of width 108*a* to length 108*b*. As illustrated in FIG. 7B and FIG. 7C, when length 108*b* is longer than width 108*a*, a progressive wave in waveguide structure 108 travels strongly to horn 113.

The configuration in which length 108*b* is longer than width 108*a* causes the progressive wave to travel strongly to horn 113 in waveguide structure 108. Thus, this configuration can help lighten a burden of reducing a leakage of a microwave. In other words, the configuration can be effective in intensifying a microwave radiated to a target area. Therefore, it is possible to further enhance the leakage reducing performance and to radiate a microwave strongly from rotating antenna 105*a* to a target area. Consequently, microwave oven 101 can radiate a microwave strongly in a direction toward a substance to be heated that a user wants to warm and can enhance the leakage reducing performance in a direction the user does not want to warm in.

According to this configuration, choke sections 117 successfully generate a relatively low impedance region in flanges 112 so as to surround side-wall surfaces 110. Consequently, it is possible to enhance the leakage reducing performance and to cause a microwave that has not leaked to be radiated from horn 113.

As described above, rotating antenna 105*a* according to this exemplary embodiment has waveguide structure 108 and includes: ceiling surface 109 that faces bottom surface 111 in heating chamber 102; side-wall surfaces 110 that are formed perpendicularly with respect to ceiling surface 109; and horn 113 from which a microwave is radiated into the heating chamber.

Rotating antenna 105*a* further includes flanges 112 formed at the edges of side-wall surfaces 110 so that flanges 112 face bottom surface 111 and surround corresponding side-wall surfaces 110. Each flange 112 has choke section 117 that reduces a leakage of a microwave.

According to the exemplary embodiment described above, when a part of substances to be heated arranged on a plate is a food that a user does not want to warm, microwave oven 101 can selectively supply a microwave to an area in which a food that the user wants to warm is present, with a minimal risk of the microwave being supplied to an area in which the food that the user does not want to warm is present. In short, microwave oven 101 can selectively heat an area in which a food that a user wants to warm is present, with a minimal risk of heating a food that the user does not want to warm.

Second Exemplary Embodiment

Figure 8:
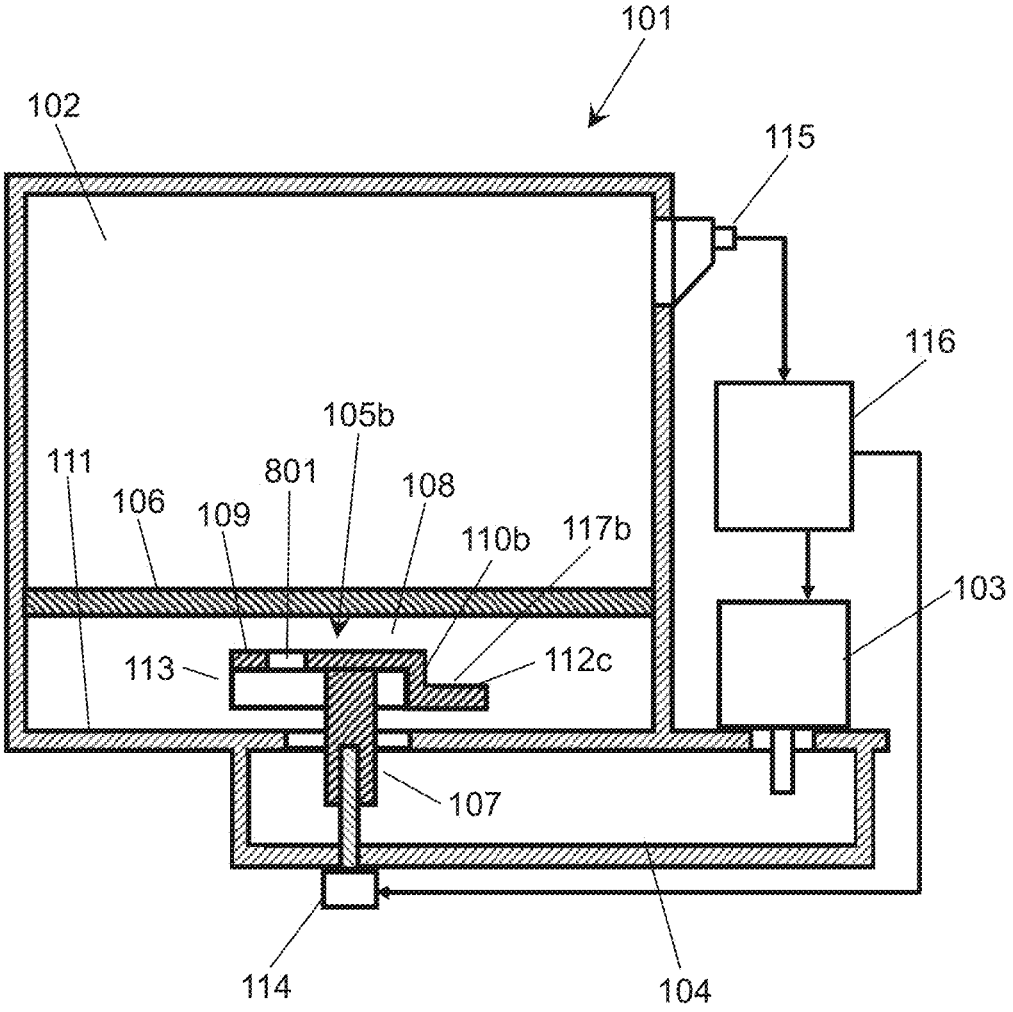
FIG. 8 is a block diagram of a microwave heating device according to a second exemplary embodiment, including its front cross-sectional view.
Figure 9:
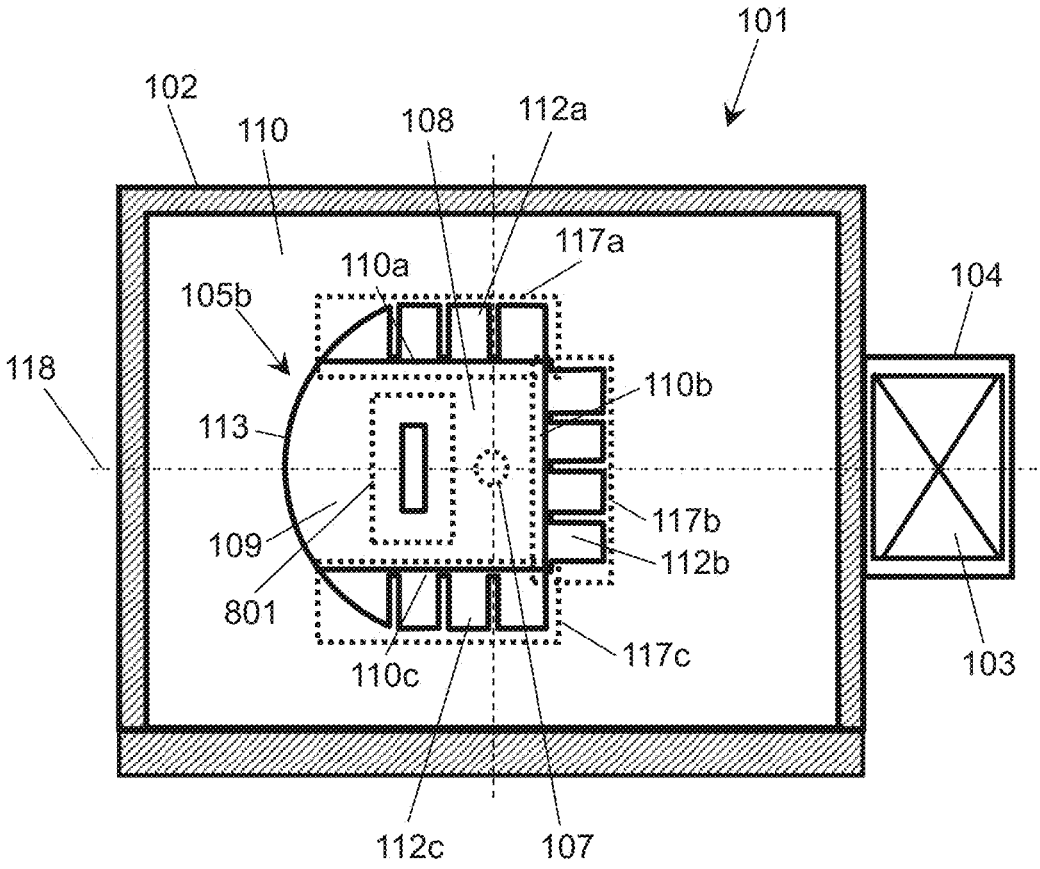
FIG. 9 is a cross-sectional, plan view of the microwave heating device according to the second exemplary embodiment as seen from the above.

FIG. 8 to FIG. 11B are views used to explain a configuration of a microwave heating device according to a second exemplary embodiment of the present disclosure. FIG. 8 is a block diagram of a microwave heating device according to this exemplary embodiment, including its front cross-sectional view. FIG. 9 is a cross-sectional, plan view of the microwave heating device according to this exemplary embodiment as seen from the above.

The configuration, operation, and effect will be described below. The identical letters are given to parts in the individual drawings which are the same as or correspond to those in the first exemplary embodiment, and descriptions of these parts will be skipped as appropriate.

A basic operation of this exemplary embodiment is the same as that of the first exemplary embodiment. As illustrated in FIG. 8 and FIG. 9, this exemplary embodiment differs from the first exemplary embodiment in that rotating antenna 105*b* has opening 801 in ceiling surface 109.

Opening 801 is a rectangular slit that is formed in ceiling surface 109 between coupling shaft 107 and horn 113 and extends in a direction perpendicular to the center line of waveguide structure 108 which passes through the center of coupling shaft 107 and the middle of horn 113.

Similar to rotating antenna 105*a* in the first exemplary embodiment, rotating antenna 105*b* has flanges 112. Accordingly, rotating antenna 105*a* provides the same leakage reducing performance as the first exemplary embodiment. For this reason, rotating antenna 105*b* can radiate a microwave that has been prevented from leaking by flanges 112 from horn 113 as well as opening 801. According to this exemplary embodiment, it is possible to increase directivity of a microwave radiated to a target area.

Figure 10:
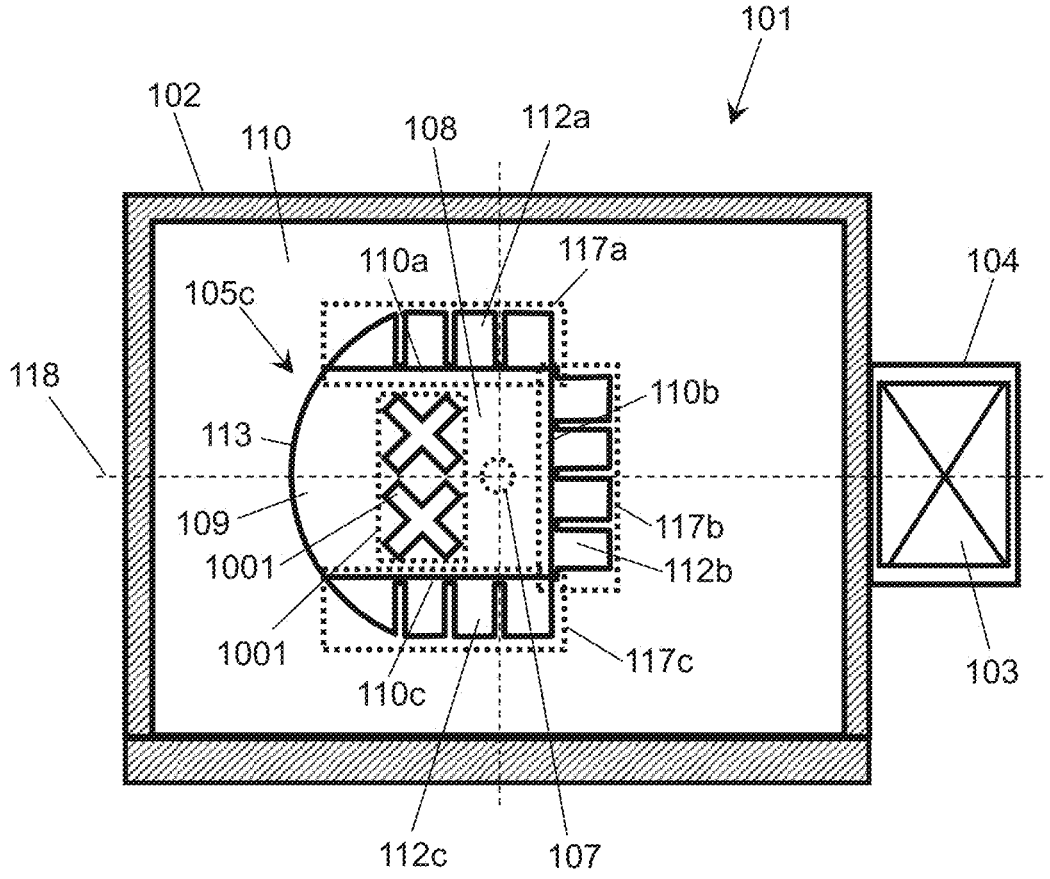
FIG. 10 is a cross-sectional, plan view of a microwave heating device according to a modification of the second exemplary embodiment as seen from the above.

FIG. 10 is a cross-sectional, plan view of a microwave heating device according to a modification of this exemplary embodiment as seen from the above. As illustrated in FIG. 10, this configuration provides ceiling surface 109 of rotating antenna 105*c* with opening 1001 through which rotation round polarization is generated.

The rotation round polarization is a technique employed widely in a mobile communication field and a satellite communication field. Its familiar examples include a system for automatically collecting expressway tolls from passing-by cars, or the so-called electronic toll collection system.

The rotation round polarization is a microwave in which the plane of polarization of an electric field rotates with time in a travel direction of an electromagnetic wave. When the rotation round polarization is generated, a direction of the electric field continues to change with time but the electric field intensity does not change.

If the rotation round polarization described above is applied to microwave heating, the microwave is dispersed over a wide range in comparison with conventional microwave heating using a linearly polarized wave. As a result, microwave oven 101 can uniformly heat substances to be heated by means of a microwave. This uniform heating tends to be prominent, especially in a circumferential direction of the rotation round polarization.

The rotation round polarization is classified into clockwise rotation round polarization and counterclockwise rotation round polarization, in accordance with a rotational direction, but both of them provide the same microwave heating performance.

As illustrated in FIG. 10, openings 1001 each include two rotation round polarization openings. Each rotation round polarization opening has a cross slot shape in which two rectangular slits are orthogonal to each other. These rotation round polarization openings are formed with their centers shifted from center line 118 of waveguide structure 108.

When a microwave passes through openings 1001 configured above, rotation round polarization is generated.

More concretely, rotating antenna 105*c* may be designed in the following manner.

Each flange 112 has a length of 30 mm. Each choke section 117 employs a slit system in which slits having a width of 5 mm are formed at intervals of 26 mm. Waveguide structure 108 has a width of 80 mm and a length of 110 mm. Each of openings 1001 includes two rotation round polarization openings having a cross slit shape. The two rectangular slits (having a length of 45 mm and a width of 10 mm) of each rotation round polarization opening which are orthogonal to each other are positioned 35 mm away from coupling shaft 107 in a direction toward horn 113.

A function and an effect of rotating antenna 105*c* will be described.

Figure 11A:
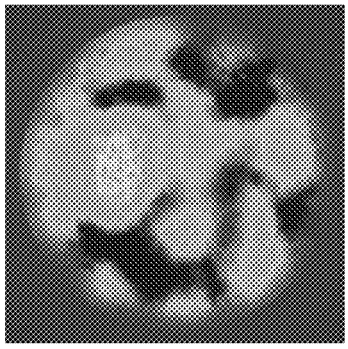
FIG. 11A is a view showing a heating experimental result when flanges are each provided with no choke section and a ceiling surface is provided with no opening.
Figure 11B:
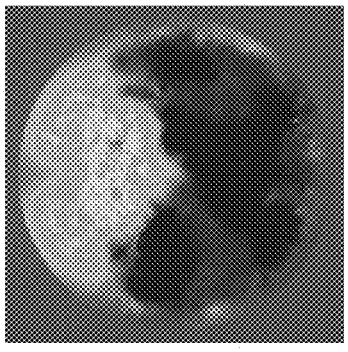
FIG. 11B is a view showing a heating experimental result when flanges are each provided with a choke section and a ceiling surface is provided with an opening.

FIG. 11A and FIG. 11B each show a heating distribution of a round plate observed with a thermo-viewer, and frozen pilaf is piled evenly over this plate and heated by a microwave from a rotating antenna that is stationary and oriented left.

In the example of FIG. 11A, the rotating antenna that is provided with no choke section in each flange and no opening in the ceiling surface is used. In the example of FIG. 11B, rotating antenna 105*c* illustrated in FIG. 10 is used. In these drawings, bright areas have a higher temperature than dark areas.

As is clear from FIG. 11A and FIG. 11B, the latter example shows a heating distribution concentrated leftward in comparison with the former example.

According to the exemplary embodiment described above, it is possible to create a uniform heating distribution in the vicinity of the opening by radiating a rotation-round-polarized microwave into the heating chamber. Rotating antenna 105*c* has flanges 112, similar to rotating antenna 105*a* in the first exemplary embodiment. Accordingly rotating antenna 105*c* provides the same leakage reducing performance as the first exemplary embodiment.

For the above reason, rotating antenna 105*c* can radiate a microwave that has been prevented from leaking by flanges 112 from horn 113 as well as opening 1001. According to this exemplary embodiment, it is possible to help lighten a burden of reducing a leakage of a microwave and to radiate a large amount of microwave to a target area.

A shape of opening 1001 is not limited to that illustrated in FIG. 10. Alternatively for example, other various shapes are applicable, as the examples illustrated in FIG. 12B to FIG. 12F.

FIG. 12A to FIG. 12F are views of exemplary shapes of each rotation round polarization opening in opening 1001.

Figure 12A:
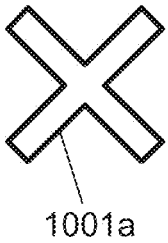
FIG. 12A is a view of an exemplary shape of a rotation round polarization opening.
Figure 12B:
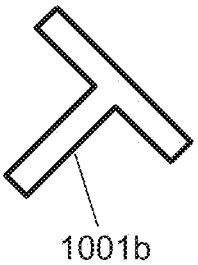
FIG. 12B is a view of an exemplary shape of a rotation round polarization opening.
Figure 12C:
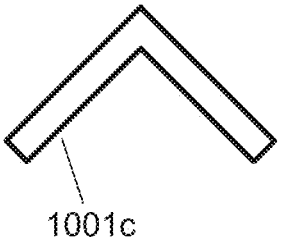
FIG. 12C is a view of an exemplary shape of a rotation round polarization opening.

The rotation round polarization opening illustrated in FIG. 12A is identical to that illustrated in FIG. 10. The rotation round polarization opening illustrated in FIG. 12B has two rectangular slits that do not intersect with each other and has a shape like an alphabetical character "T". The rotation round polarization opening illustrated in FIG. 12C has two rectangular slits that do not intersect with each other and has a shape like an alphabetical character "L".

Figure 12D:
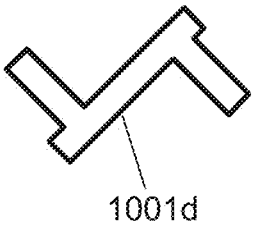
FIG. 12D is a view of an exemplary shape of a rotation round polarization opening.

The rotation round polarization opening illustrated in FIG. 12D has two short rectangular slits and a long rectangular slit, the two short rectangular slits extending in different directions from the ends or their adjacent portions of the long rectangular slit and perpendicularly with respect to the long rectangular slit.

Figure 12E:
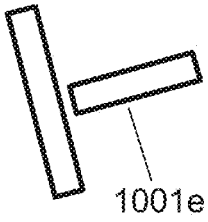
FIG. 12E is a view of an exemplary shape of a rotation round polarization opening.
Figure 12F:
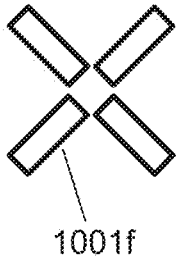
FIG. 12F is a view of an exemplary shape of a rotation round polarization opening.

The rotation round polarization opening illustrated in FIG. 12E has two rectangular slits that are a predetermined distance away from each other and has a shape like an alphabetical character "T". The rotation round polarization opening illustrated in FIG. 12F has four rectangular slits that have the same length and form a right angle with one another to have a cross shape.

In this exemplary embodiment, opening 801 is formed in ceiling surface 109 of rotating antenna 105*b*, and opening 1001 is formed in ceiling surface 109 of rotating antenna 105*c*. However, these configurations are not limiting. Alternatively, opening 801 may be formed in side-wall surface 110 of rotating antenna 105*b*, and opening 1001 may be formed in side-wall surface 110 of rotating antenna 105*c*. Moreover, openings 801 may be formed in both ceiling surface 109 and side-wall surface 110 of rotating antenna 105*b*, and openings 1001 may be formed in both ceiling surface 109 and side-wall surface 110 of rotating antenna 105*c*. These configurations can also produce the same effect.

Third Exemplary Embodiment

Figure 13:
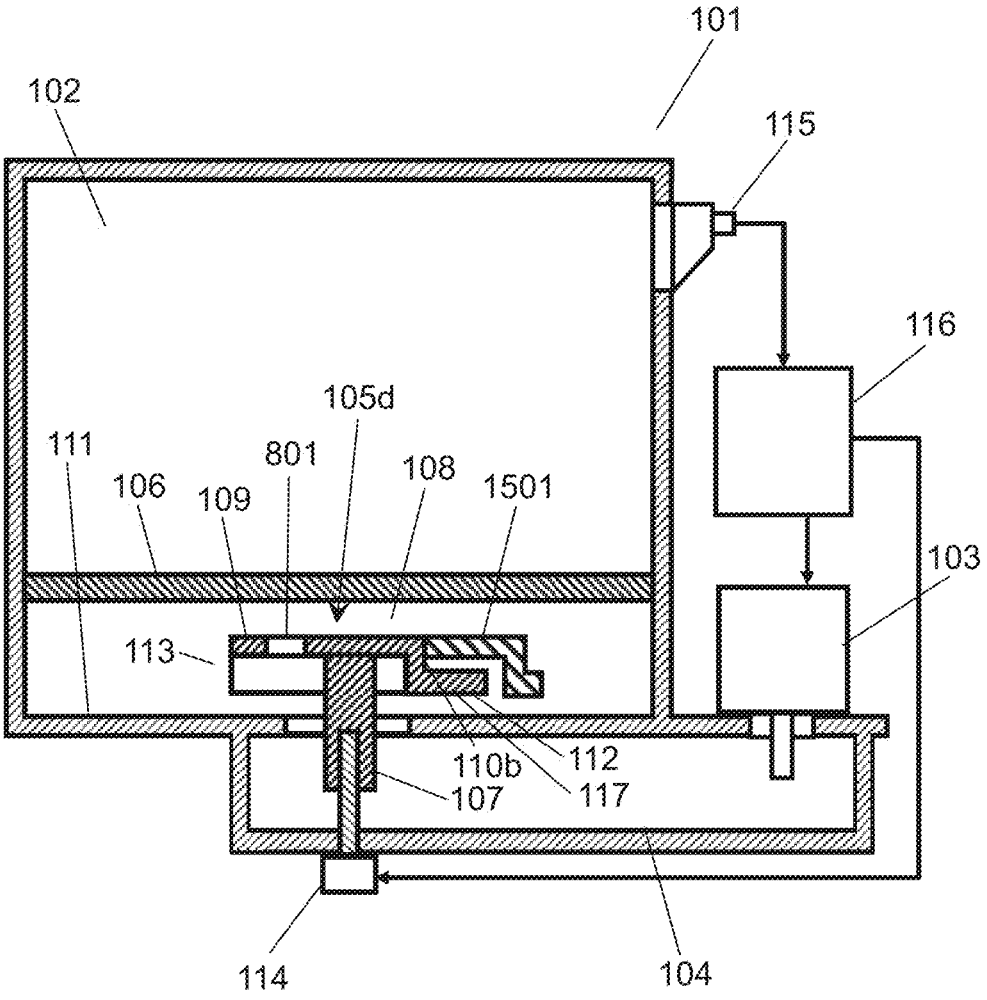
FIG. 13 is a block diagram of a microwave heating device according to a third exemplary embodiment, including its front cross-sectional view.
Figure 14:
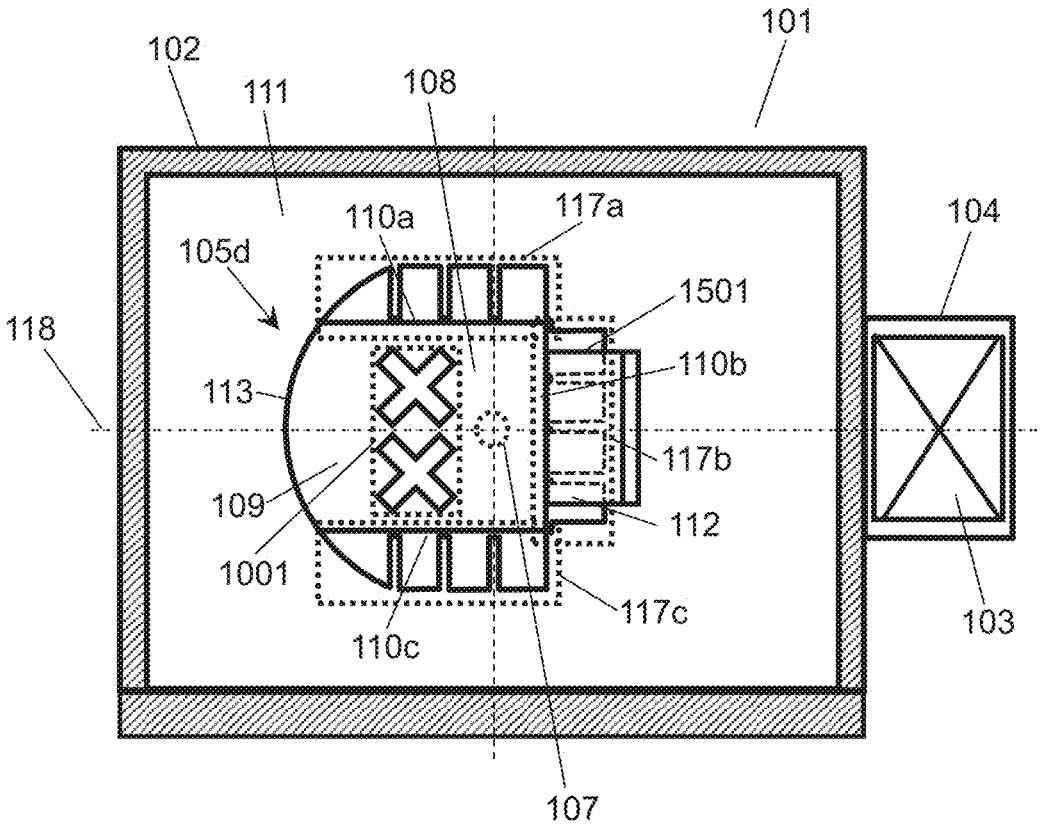
FIG. 14 is a cross-sectional, plan view of the microwave heating device according to the third exemplary embodiment as seen from the above.

FIG. 13 to FIG. 17D are views used to explain configurations of a microwave heating device in a third exemplary embodiment of the present disclosure. FIG. 13 is a block diagram of a microwave heating device according to this exemplary embodiment, including its front cross-sectional view. FIG. 14 is a cross-sectional, plan view of the microwave heating device according to this exemplary embodiment as seen from the above.

The configuration, operation, and effect will be described below. The identical letters are given to parts in the individual drawings which are the same as or correspond to those in the first and second exemplary embodiments, and descriptions of these parts will be skipped as appropriate.

A basic operation of this exemplary embodiment is the same as that of the first and second exemplary embodiments. As illustrated in FIG. 13 and FIG. 14, this exemplary embodiment differs from the first and second exemplary embodiments in that rotating antenna 105*d* has resonator 1501.

As illustrated in FIG. 13 and FIG. 14, resonator 1501 is formed so as to cover both side-wall surface 110*b* and flange 112*b*. Both side-wall surface 110*b* and flange 112*b* serve as a part of constitute resonator 1501, constituting resonator 1501. This configuration reserves a resonant space surrounded by side-wall surface 110, flange 112, and resonator 1501.

According to this exemplary embodiment, resonator 1501 confines, in the resonant space, a microwave that has slightly leaked from choke section 117, thereby suppressing the microwave from escaping to the outside of resonator 1501. In short, resonator 1501 functions as a supplementary member for choke section 117.

In this exemplary embodiment, resonator 1501 is formed outside both side-wall surface 110*b* and flange 112*b*. However, the entire choke section including resonator 1501 can be compact in size. Thus, this configuration successfully controls enlargement of the rotating antenna.

A description will be given below of an operation and an effect of a resonator according to this exemplary embodiment, with reference to some accompanying drawings.

Figure 15A:
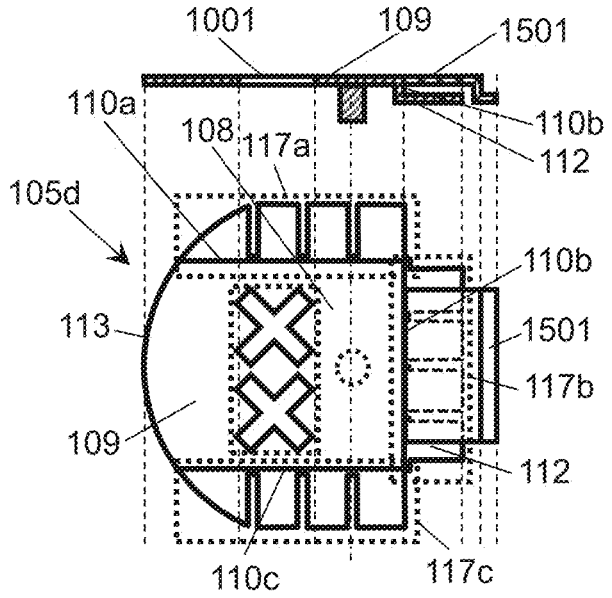
FIG. 15A is a top plan view and a side view used to explain a configuration of the rotating antenna according to the third exemplary embodiment.
Figure 15B:
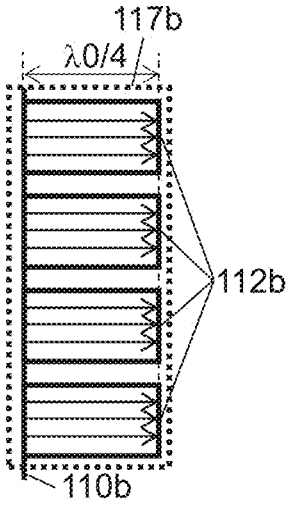
FIG. 15B is a view used to explain a scheme in which a choke section reduces a leakage of a microwave that has entered a flange perpendicularly.

FIG. 15A is a top plan view and a side view used to explain a configuration of rotating antenna 105*d* according to this exemplary embodiment. FIG. 15B is a view used to explain a scheme in which choke section 117*b* reduces a leakage of a microwave that has entered flange 112*b* perpendicularly.

Figure 15C:
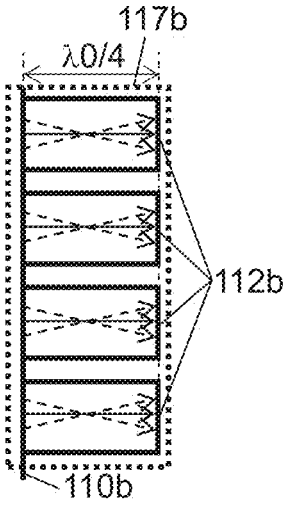
FIG. 15C is a view used to explain a scheme in which a choke section reduces a leakage of a microwave that has entered a flange somewhat diagonally.
Figure 15D:
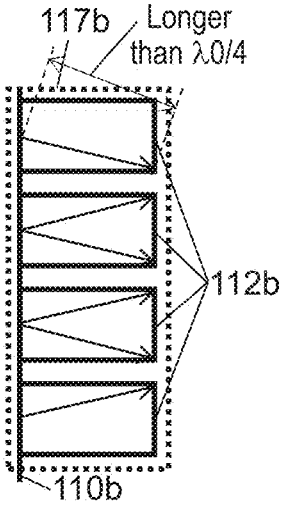
FIG. 15D is a view used to explain a scheme in which a microwave that has entered diagonally a flange leaks from a choke section.

FIG. 15C is a view used to explain a scheme in which choke section 117*b* reduces a leakage of a microwave that has entered flange 112*b* somewhat diagonally. FIG. 15D is a view used to explain a scheme in which a microwave that has entered further diagonally flange 112*b* leaks from choke section 117.

As illustrated in FIG. 15A, similar to the first exemplary embodiment, slits are formed in flange 112*b* at intervals of one quarter of a wavelength of a microwave generated by magnetron 103, thereby constituting choke section 117*b*. Due to this configuration, choke section 117*b* reduces a leakage of a microwave that has entered perpendicularly flange 112*b* (see FIG. 15B).

Choke section 117*b* has a function of adjusting a microwave that would leak diagonally with respect to flange 112*b* so as to travel in a direction substantially perpendicular to flange 112*b*. As illustrated in FIG. 15C, a vector synthesis adjusts a microwave that would leak diagonally (a dotted line in the drawing) so as to enter flange 112 perpendicularly (a solid line in the drawing).

Due to the above function, choke section 117*b* can reduce a leakage of a microwave, similar to the case of FIG. 15B. This function is referred to below as a function of adjusting a leaking direction of a microwave with slits.

As illustrated in FIG. 15D, unfortunately, flange 112 may fail to reduce a leakage of a microwave that has entered flange 112 diagonally with respect to the corners of flange 112, because the length of flange 112 does not match this microwave.

Figure 16A:
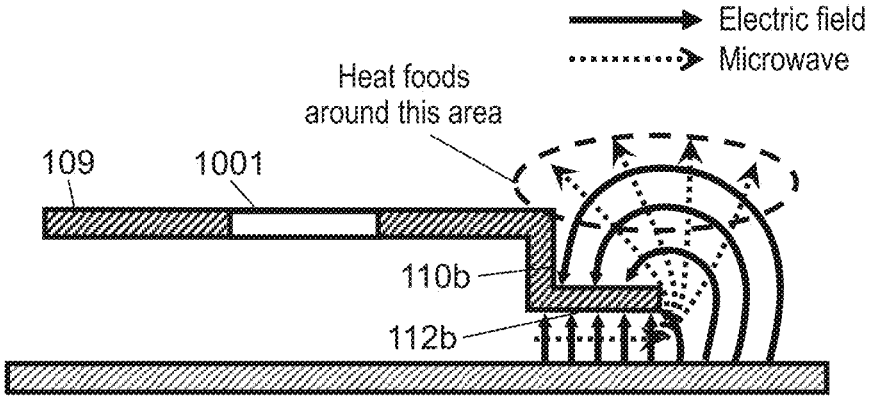
FIG. 16A is a view used to explain a behavior of a leaked microwave.

FIG. 16A is a view used to explain a behavior of a leaked microwave. In FIG. 16A, the solid line arrows denote an electric field and its direction, and the dotted line arrows denote a microwave and its orientation. As illustrated in FIG. 16A, a small amount of leaked microwave may be a cause of generating an electric field outside flange 112*b*, and this electric field might be a cause of accidentally heating surrounding foods.

Figure 16B:
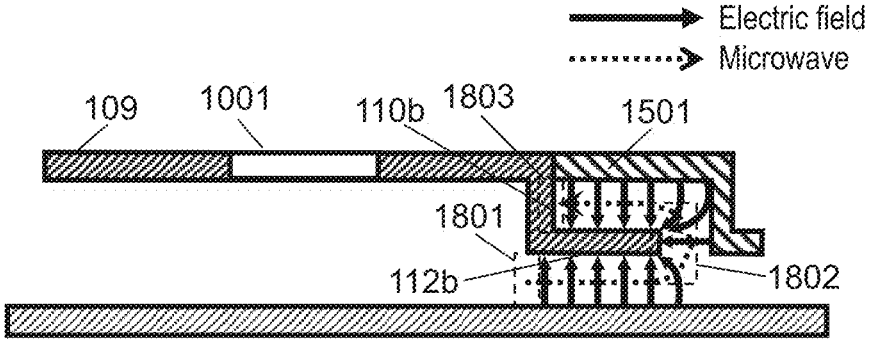
FIG. 16B is a view used to explain an operation of the resonator according to the third exemplary embodiment.

FIG. 16B is a view used to explain an operation of resonator 1501 according to this exemplary embodiment. In FIG. 16B, the solid line arrows denote an electric field and its orientation, and the dotted line arrows denote a microwave and its direction. As illustrated in FIG. 16B, resonator 1501 according to this exemplary embodiment is formed so as to cover flange 112*b* and side-wall surface 110*b*. Flange 112*b* constitutes a part of resonator 1501.

In this exemplary embodiment, the length of flange 112 is set to one quarter of a wavelength of a microwave. Therefore, in FIG. 16B, the length of the route starting from point 1801, passing through point 1802, and ending at point 1803 is equal to substantially one half of the wavelength of the microwave.

In this exemplary embodiment, the leaked microwave creates a stable standing wave with an amplitude node positioned at point 1801, the amplitude antinode positioned at point 1802, and the other amplitude node positioned at point 1803. In this case, the space surrounded by flange 112*b*, side-wall surface 110*b*, and resonator 1501 functions as a resonant space in which a leaked microwave is confined. In this way, resonator 1501 exhibits a good leakage reducing performance.

Figure 16C:
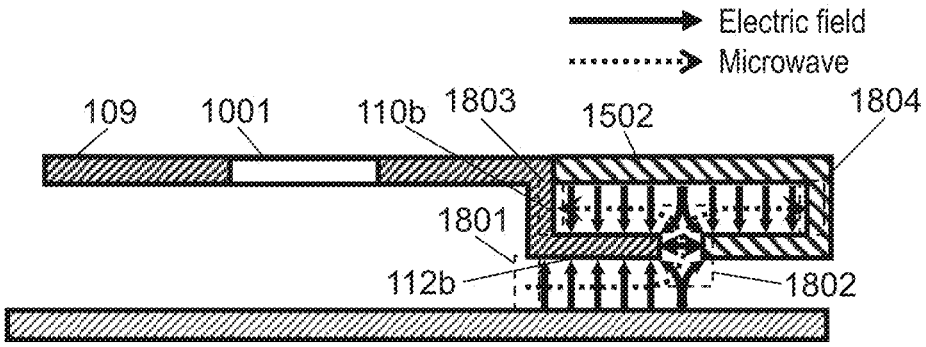
FIG. 16C is a view used to explain a configuration and an operation of the resonator according to a modification of the third exemplary embodiment.

FIG. 16C is a view used to explain a configuration and an operation of resonator 1502 according to a modification of this exemplary embodiment. In FIG. 16C, the solid line arrows denote an electric field and its orientation, and the dotted line arrows denote a microwave and its direction.

In FIG. 16C, the length of the route starting from point 1801, passing through point 1802, and ending at point 1803 is equal to substantially one half of the wavelength of the microwave, similar to FIG. 16B. Likewise, the length of the route starting from point 1801, passing through point 1802, and ending at point 1804 is equal to substantially one half of the wavelength of the microwave, and thus this space also functions as a resonant space. This means that resonator 1502 has a plurality of resonant spaces. This configuration can enhance the leakage reducing performance.

Figure 17A:
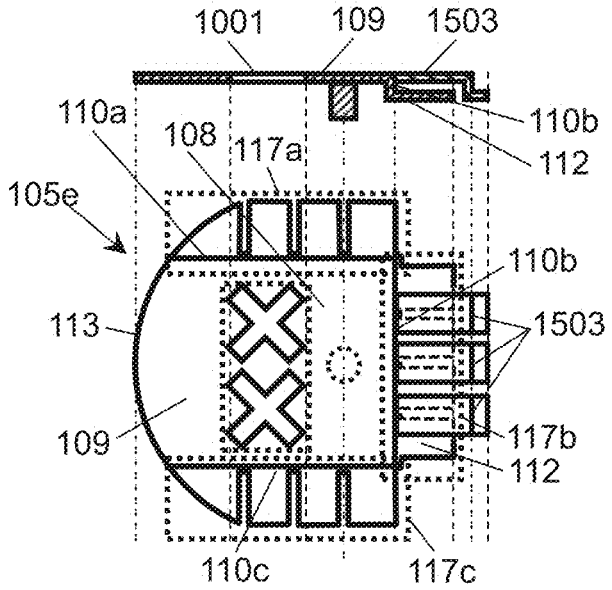
FIG. 17A is a top plan view and a side view used to explain a configuration of a rotating antenna according to another modification of the third exemplary embodiment.
Figure 17B:
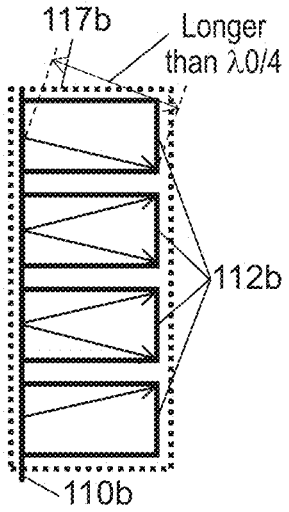
FIG. 17B is a view used to explain a scheme in which a microwave that has entered diagonally in a flange leaks from a choke section.
Figure 17C:
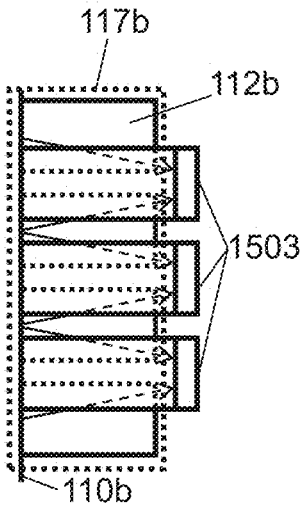
FIG. 17C is a view used to explain a configuration and an operation of the resonator according to the third exemplary embodiment.
Figure 17D:
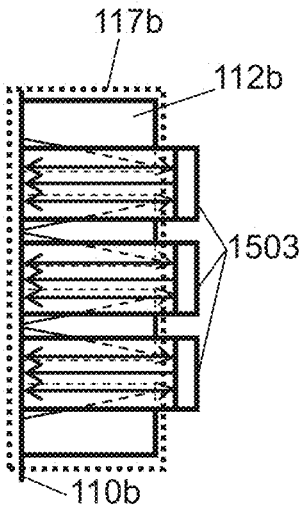
FIG. 17D is a view used to explain a function of rectifying a leaked microwave performed by a resonator with a slit in the third exemplary embodiment.
Figure 18A:
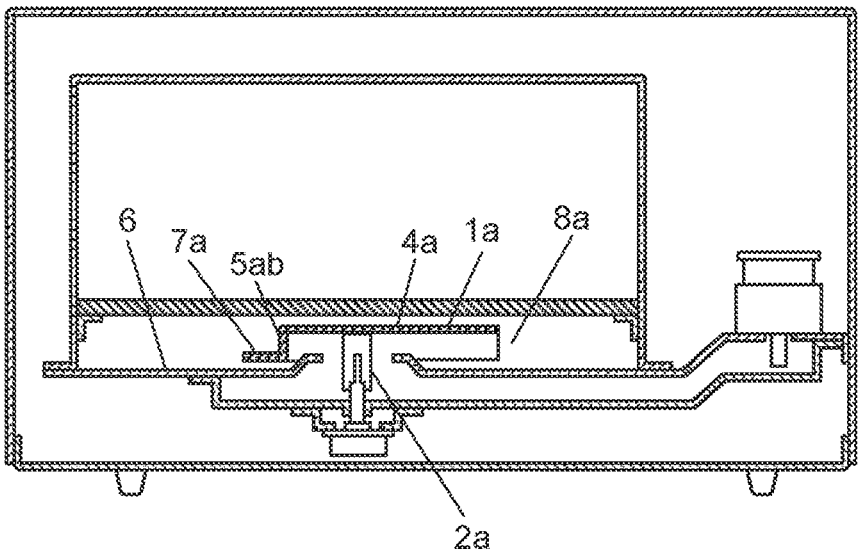
FIG. 18A (PRIOR ART)
FIG. 18A is a front cross-sectional view of a conventional microwave heating device described in Patent Literature 1.
Figure 18B:
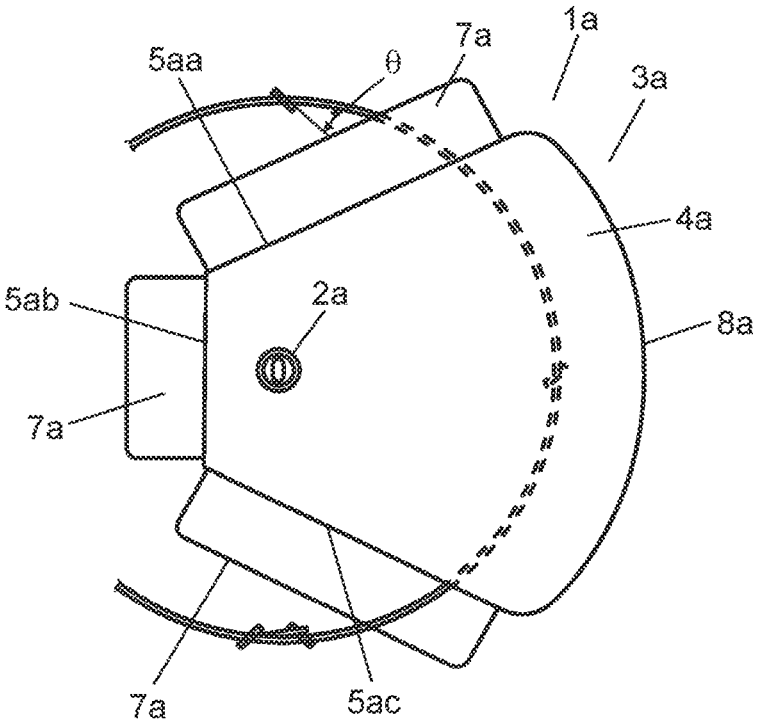
FIG. 18B (PRIOR ART)
FIG. 18B is a plan view of the conventional rotating antenna described in Patent Literature 1.
Figure 19A:
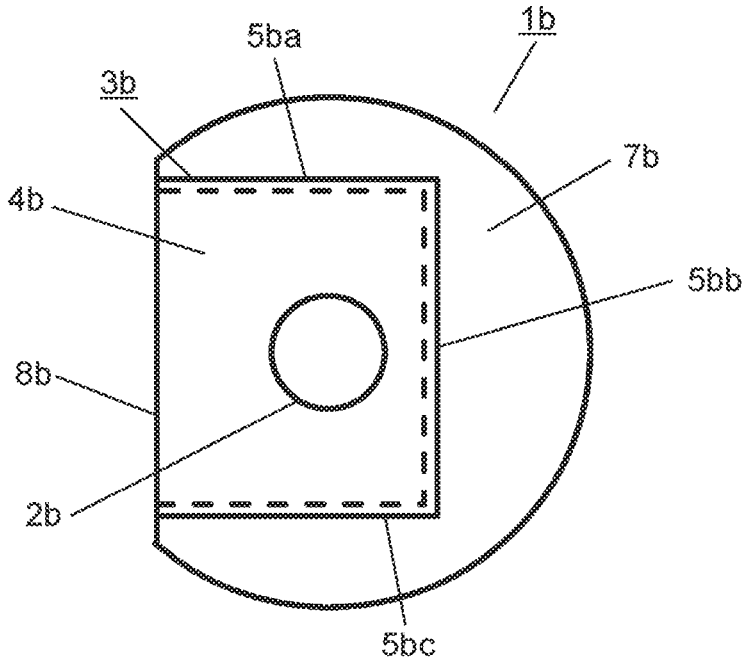
FIG.19A (PRIOR ART)
FIG. 19A is a plan view of a conventional rotating antenna described in Patent Literature 2.
Figure 19B:
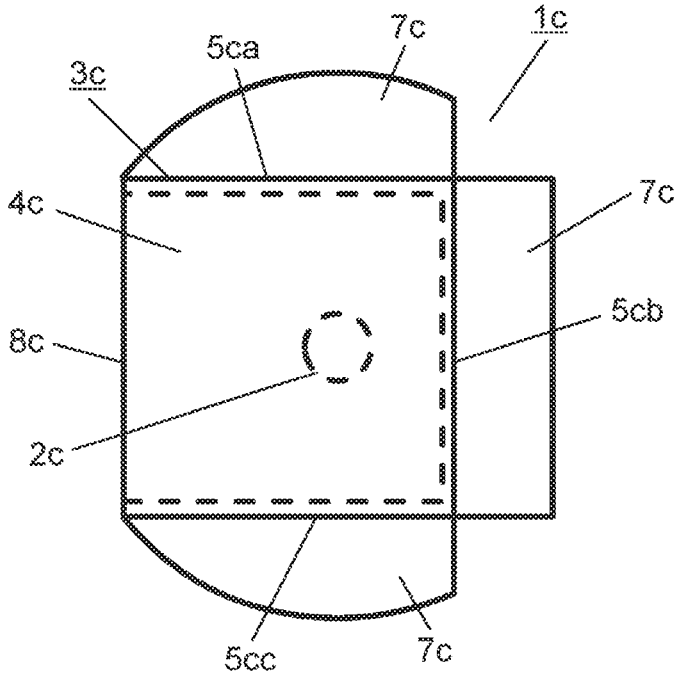
FIG. 19B (PRIOR ART)
FIG. 19B is a plan view of another conventional rotating antenna described in Patent Literature 2.

FIG. 17A is a top plan view and a side view used to explain a configuration of rotating antenna 105*e* according to another modification of this exemplary embodiment. FIG. 17B, which is identical to FIG. 15D, is a view used to explain a scheme in which a microwave that has entered flange 112*b* diagonally leaks from choke section 117*b*. FIG. 17C and FIG. 17D are views used to explain an operation of resonator 1503 according to another modification of this exemplary embodiment.

As illustrated in FIG. 17A, resonator 1503 is formed in rotating antenna 105*e* and has slits formed at regular intervals, similar to flange 112*b*. Each slit in resonator 1503 is formed between two slits in flange 112*b* so that the slits in resonator 1503 are not aligned with the slits in flange 112*b*.

As illustrated in FIG. 17B, resonator 1503 receives a microwave that has leaked from choke section 117*b*. In addition, the slits formed in resonator 1503 produce the effect of adjusting a leaking direction of a microwave described above (see FIG. 17D). As a result, choke section 117*b* can reduce a leakage of the adjusted microwave. Thus, this configuration can enhance the leakage reducing performance.

According to this modification, as described above, slits are formed in both flange 112 and resonator 1503, and the slits formed in resonator 1503 and the slits formed in flange 112*b* are positioned alternately so as not to be aligned with each other. Consequently, it is possible to enhance the leakage reducing performance.

In this exemplary embodiment, resonators 1501, 1502, 1503 are formed only in flange 112*b*. However, the same resonators may be formed in flanges 112*a*, 112*c*. This configuration can further enhance the leakage reducing performance.

The reason why the configuration in which resonators 1501, 1502, 1503 are formed only in flange 112*b* is exemplified is that flange 112*b* is positioned closest to coupling shaft 107 and thus a microwave is the most likely to leak from flange 112*b*.

The slits are formed in flange 112*b* and resonator 1503 in order to suppress a leaked microwave from traveling in diagonal directions. In this case, it is necessary to set each interval between the slits to be equal to or shorter than at least one quarter of a wavelength of a microwave.

In the exemplary embodiments described above, rotating antennas 105*a* to 105*e* are installed under bottom surface 111. However, rotating antennas 105*a* to 105*e* may be installed close to the ceiling of heating chamber 102, which is another wall surface of heating chamber 102, so as to face the ceiling of heating chamber 102. This configuration also produces the same effect.

INDUSTRIAL APPLICABILITY

As described in detail, a microwave heating device of the present disclosure is applicable to microwave heating devices that heat or disinfect foods, for example.

REFERENCE MARKS IN THE DRAWINGS

1*a*, 1*b*, 1*c*, 105*a*, 105*b*, 105*c*, 105*d*, 105*e*: rotating antenna
2*a*, 2*b*, 2*c*, 107: coupling shaft
3*a*, 3*b*, 3*c*, 108: waveguide structure
4*a*, 4*b*, 4*c*, 109: ceiling surface
5*aa*, 5*ab*, 5*ac*, 5*ba*, 5*bb*, 5*bc*, 5*ca*, 5*cb*, 5*cc*, 110, 110*a*, 110*b*, 110*c*: side-wall surface
6, 111: bottom surface
7*a*, 7*b*, 7*c*, 112, 112*a*, 112*b*, 112*c*: flange
8*a*, 8*b*, 8*c*, 113: horn
101: microwave oven
102: heating chamber
103: magnetron
104: waveguide

104*a*, 108*a*: width
104*b*: height
106: mounting table
108*b*: length
114: driver
115: infrared sensor
116: controller
117, 117*a*. 117*b*. 117*c*: choke section
118: center line
301: H plain
302: E plain
401, 402: gap adjuster
801, 1001: opening
1501, 1502, 1503: resonator
1801, 1802, 1803, 1804: point

The invention claimed is:

1. A microwave heating device comprising:

a heating chamber that accommodates a substance to be heated;

a microwave generator that generates a microwave;

a rotating antenna including a ceiling surface, a side-wall surface, and a microwave radiator, the ceiling surface including a first peripheral edge, a second peripheral edge, a third peripheral edge, and a fourth peripheral edge, the side-wall surface including a first side-wall surface which is connected to the first peripheral edge of the ceiling surface, a second side-wall surface which is connected to the second peripheral edge of the ceiling surface, and a third side-wall surface which is connected to the third peripheral edge of the ceiling surface, the fourth peripheral edge of the ceiling surface constituting a horn through which the microwave is radiated, the ceiling surface and the side-wall surface constituting a waveguide structure, the rotating antenna radiating the microwave through the horn from the microwave radiator into the heating chamber;

a driver that rotates the rotating antenna; and a controller that controls the microwave generator and the driver, wherein the rotating antenna further includes a flange that is formed on a periphery of the side-wall surface so as to face an inner wall surface of the heating chamber and so as to surround the side-wall surface, the flange including a first flange that is connected to the first side-wall surface, a second flange that is connected to the second side-wall surface, and a third flange that is connected to the third side-wall surface, at least one of the first flange, the second flange, or the third flange has choke sections that reduce a leakage of the microwave, the flange further has an open end, the choke sections are configured to set impedance at the open end of the flange to be lower than impedance of the side-wall surface.

2. The microwave heating device according to claim 1, wherein a length between the periphery of the side-wall surface and an edge of the flange is equal to one quarter of a wavelength of the microwave.

3. The microwave heating device according to claim 1, wherein the rotating antenna further includes a coupling shaft that has a first end coupled to the ceiling surface and a second end coupled to the driver, and a length of the ceiling surface in a direction parallel to a center line of the waveguide structure which passes through a center of the coupling shaft and a middle of the microwave radiator is greater than a length of the ceiling surface in a direction perpendicular to the center line.

4. The microwave heating device according to claim 1, wherein the ceiling surface has at least one opening.

5. The microwave heating device according to claim 4, wherein the rotating antenna further includes a coupling shaft that has a first end coupled to the ceiling surface and a second end coupled to the driver, the at least one opening is positioned shifted from a center line of the waveguide structure which passes through a center of the coupling shaft and a middle of the microwave radiator, and rotation round polarization is radiated from the opening.

6. The microwave heating device according to claim 1, wherein:

the choke sections are formed in the flange by configuring the flange to provide a gap between the flange and the inner wall surface of the heating chamber changes with location.

7. The microwave heating device according to claim 1, wherein:

the choke sections are formed in the flange by configuring a first gap portion of the gap between an end of the flange, the end being closer to a rotational axis of the rotating antenna, and the inner wall surface of the heating chamber to be larger than a second gap portion of the gap between the open end of the flange and the inner wall surface of the heating chamber.

8. The microwave heating device according to claim 1, wherein:

a length between a periphery of the first side-wall surface and an edge of the first flange is equal to one quarter of a wavelength of the microwave.

9. A microwave heating device comprising:

a heating chamber that accommodates a substance to be heated;

a microwave generator that generates a microwave;

a rotating antenna including a ceiling surface, a side-wall surface, and a microwave radiator, the ceiling surface including a first peripheral edge, a second peripheral edge, a third peripheral edge, and a fourth peripheral edge, the side-wall surface including a first side-wall surface which is connected to the first peripheral edge of the ceiling surface, a second side-wall surface which is connected to the second peripheral edge of the ceiling surface, and a third side-wall surface which is connected to the third peripheral edge of the ceiling surface, the fourth peripheral edge of the ceiling surface constituting a horn through which the microwave is radiated, the ceiling surface and the side-wall surface constituting a waveguide structure, the rotating antenna radiating the microwave through the horn from the microwave radiator into the heating chamber;

a driver that rotates the rotating antenna; and a controller that controls the microwave generator and the driver, wherein the rotating antenna further includes a flange that is formed on a periphery of the side-wall surface so as to face an inner wall surface of the heating chamber and so as to surround the side-wall surface, the flange including a first flange that is connected to the first side-wall surface, a second flange that is connected to the second side-wall surface, and a third flange that is connected to the third side-wall surface, at least one of the first flange, the second flange, or the third flange has choke sections that reduce a leakage of the microwave, the choke sections are configured to generate a low impedance region in the flange relative to other region of the flange, the low impedance region surrounding side-wall surfaces, and the choke sections in the flange include slits formed in the flange, the slits being formed at intervals shorter than one quarter of a wavelength of the microwave.

10. The microwave heating device according to claim 9, wherein the choke sections are disposed periodically in the flange.

11. A microwave heating device comprising:

a heating chamber that accommodates a substance to be heated;

a microwave generator that generates a microwave;

a rotating antenna including a ceiling surface, a side-wall surface, and a microwave radiator, the ceiling surface including a first peripheral edge, a second peripheral edge, a third peripheral edge, and a fourth peripheral edge, the side-wall surface including a first side-wall surface which is connected to the first peripheral edge of the ceiling surface, a second side-wall surface which is connected to the second peripheral edge of the ceiling surface, and a third side-wall surface which is connected to the third peripheral edge of the ceiling surface, the fourth peripheral edge of the ceiling surface constituting a horn through which the microwave is radiated, the ceiling surface and the side-wall surface constituting a waveguide structure, the rotating antenna radiating the microwave through the horn from the microwave radiator into the heating chamber;

a driver that rotates the rotating antenna; and a controller that controls the microwave generator and the driver, wherein the rotating antenna further includes a flange that is formed on a periphery of the side-wall surface so as to face an inner wall surface of the heating chamber and so as to surround the side-wall surface, the flange including a first flange that is connected to the first side-wall surface, a second flange that is connected to the second side-wall surface, and a third flange that is connected to the third side-wall surface, wherein at least one of the first flange, the second flange, or the third flange has choke sections that reduce a leakage of the microwave, wherein the side-wall surface of the rotating antenna includes lateral side-wall surfaces on both sides and a rear-end side-wall surface, wherein a resonator is formed so as to cover the flange and the rear-end side-wall surface, and wherein there exists a resonant space which is surrounded by the rear-end side-wall surface, the flange, and the resonator.

12. The microwave heating device according to claim 11, wherein the flange constitutes a part of the resonator.

13. The microwave heating device according to claim 11, wherein slits are formed in both the flange and the resonator, and the slits formed in the resonator and the slits formed in the flange are positioned alternately so as not to be aligned with each other.

14. The microwave heating device according to claim 11, wherein:

a length between a periphery of the first side-wall surface and an edge of the first flange is equal to one quarter of a wavelength of the microwave.

15. A microwave heating device comprising:

a heating chamber that accommodates a substance to be heated;

a microwave generator that generates a microwave;

a rotating antenna including a ceiling surface, a side-wall surface, and a microwave radiator, the ceiling surface including a first peripheral edge, a second peripheral edge, a third peripheral edge, and a fourth peripheral edge, the side-wall surface including a first side-wall surface which is connected to the first peripheral edge of the ceiling surface, a second side-wall surface which is connected to the second peripheral edge of the ceiling surface, and a third side-wall surface which is connected to the third peripheral edge of the ceiling surface, the fourth peripheral edge of the ceiling surface constituting a horn through which the microwave is radiated, the ceiling surface and the side-wall surface constituting a waveguide structure, the rotating antenna radiating the microwave through the horn from the microwave radiator into the heating chamber;

a driver that rotates the rotating antenna; and a controller that controls the microwave generator and the driver, wherein the rotating antenna further includes a flange that is formed on a periphery of the side-wall surface so as to face an inner wall surface of the heating chamber and so as to surround the side-wall surface, the flange including a first flange that is connected to the first side-wall surface, a second flange that is connected to the second side-wall surface, and a third flange that is connected to the third side-wall surface, at least one of the first flange, the second flange, or the third flange has choke sections that reduce a leakage of the microwave, and the choke sections are configured to generate a low impedance region in the flange relative to other region of the flange, the low impedance region surrounding side-wall surfaces.

16. The microwave heating device according to claim 15, wherein a length between the periphery of the side-wall surface and an edge of the flange is equal to one quarter of a wavelength of the microwave.

17. The microwave heating device according to claim 15, wherein:

the rotating antenna further includes a coupling shaft that has a first end coupled to the ceiling surface and a second end coupled to the driver, and a length of the ceiling surface in a direction parallel to a center line of the waveguide structure which passes through a center of the coupling shaft and a middle of the microwave radiator is greater than a length of the ceiling surface in a direction perpendicular to the center line.

18. The microwave heating device according to claim 15, wherein:

the ceiling surface has at least one opening.

19. The microwave heating device according to claim 18, wherein:

the rotating antenna further includes a coupling shaft that has a first end coupled to the ceiling surface and a second end coupled to the driver, the at least one opening is positioned shifted from a center line of the waveguide structure which passes through a center of the coupling shaft and a middle of the microwave radiator, and rotation round polarization is radiated from the opening.

20. The microwave heating device according to claim 15, wherein:

a length between a periphery of the first side-wall surface and an edge of the first flange is equal to one quarter of a wavelength of the microwave.

* * * * *